US008035588B2

(12) United States Patent
Pan et al.

(10) Patent No.: US 8,035,588 B2
(45) **Date of Patent: *Oct. 11, 2011**

(54) LIQUID CRYSTAL DISPLAY PANEL WITH AUXILIARY LINE DISPOSED BETWEEN BOUNDARY DATA LINE AND PIXEL ELECTRODE AND DRIVING METHOD THEREOF

(75) Inventors: Hsuan-Lin Pan, Tao-Yuan Hsien (TW); Po-Sheng Shih, Tao-Yuan Hsien (TW)

(73) Assignee: HannStar Display Corp., Yang-Mei, Tao-Yuan Hsien (TW)

( * ) Notice: Subject to any disclaimer, the term of this patent is extended or adjusted under 35 U.S.C. 154(b) by 901 days.

This patent is subject to a terminal disclaimer.

(21) Appl. No.: 11/681,753

(22) Filed: Mar. 2, 2007

(65) Prior Publication Data

US 2007/0146278 A1 Jun. 28, 2007

Related U.S. Application Data

(63) Continuation-in-part of application No. 10/790,824, filed on Mar. 3, 2004, now Pat. No. 7,271,789.

(51) Int. Cl.
*G09G 3/36* (2006.01)

(52) U.S. Cl. ..... 345/87; 345/92

(58) Field of Classification Search ..... 345/87–108; 349/37, 39, 73, 84

See application file for complete search history.

(56) References Cited

U.S. PATENT DOCUMENTS

| | | | | |
|---|---|---|---|---|
| 6,140,990 | A | 10/2000 | Schlig | |
| 6,456,350 | B1 * | 9/2002 | Ashizawa et al. | 349/141 |
| 6,917,407 | B2 | 7/2005 | Jeong et al. | |
| 2002/0044246 | A1 * | 4/2002 | Moon et al. | 349/141 |
| 2002/0080313 | A1 * | 6/2002 | Lim | 349/143 |
| 2005/0035936 | A1 * | 2/2005 | Lim | 345/87 |
| 2005/0243044 | A1 * | 11/2005 | Kang et al. | 345/87 |
| 2006/0164350 | A1 * | 7/2006 | Kim et al. | 345/87 |
| 2006/0176266 | A1 * | 8/2006 | Pak et al. | 345/104 |
| 2006/0192740 | A1 * | 8/2006 | Lim | 345/93 |
| 2007/0182692 | A1 * | 8/2007 | Kwon et al. | 345/100 |
| 2008/0084529 | A1 * | 4/2008 | Wang et al. | 349/146 |

FOREIGN PATENT DOCUMENTS

| | | |
|---|---|---|
| KR | 1020040099746 | 12/2004 |
| TW | 529007 | 4/2003 |
| TW | 575851 | 2/2004 |

* cited by examiner

*Primary Examiner* — Chanh Nguyen
*Assistant Examiner* — Sanghyuk Park
(74) *Attorney, Agent, or Firm* — Winston Hsu; Scott Margo

(57) ABSTRACT

A liquid crystal display panel and its driving method are provided. The liquid crystal display panel includes: a plurality of scanning lines and data lines; a pixel matrix having a plurality of pixels which are formed in the intersections of the scanning lines and the data lines; and each of the pixels having: a pixel electrode; a control electrode; a first thin film transistor having a gate electrode connected to the scanning line, a first electrode connected to the data line and a second electrode connected to the pixel electrode; a second thin film transistor having a gate electrode connected to another adjacent scanning line, a first electrode connected to another adjacent data line and a second electrode connected to the control electrode; and wherein one of the two most outside data lines of the pixel matrix is called a boundary data line, and an auxiliary line is disposed between the boundary data line and the pixel electrode adjacent to the boundary data line.

32 Claims, 18 Drawing Sheets

LIQUID CRYSTAL DISPLAY PANEL WITH AUXILIARY LINE DISPOSED BETWEEN BOUNDARY DATA LINE AND PIXEL ELECTRODE AND DRIVING METHOD THEREOF

CROSS REFERENCE TO RELATED APPLICATIONS

This application is a Continuation-in-part of application Ser. No. 10/790,824 filed Mar. 3, 2004, hereby incorporated by reference as it fully set forth herein.

BACKGROUND OF THE INVENTION

1. Field of the Invention

The prevented invention relates to a liquid crystal display panel and a driving method thereof, especially relates to a liquid crystal display panel and its driving method, which improves the data signal providing way for the data lines and further compensates the parasitic capacitor effect.

2. Description of the Related Art

With the wide applications of liquid crystal display (LCD) panels, users have more and more demands about the quality of the LCD panel, such as high brightness, high contrast, high resolution, high color saturation and fast response time. Especially as the panel size increases, the LCD panels have generally been applied to household flat displays, such as liquid crystal (LC) TV sets, which have become an important application of the LCD panels. Most of the general, traditional LCD panels have narrow view angles, so the normal images displayed by them only can be viewed directly in front of the display area. If users watch the display area from an oblique view angle, color distortion occurs in what they watch, and even gray inversion occurs. That is, what appears black is actually white and what appears white is actually black. Therefore, how to widen the view angle is an important subject for the LCD manufacturers.

Among various methods for widening the view angle, an LC Vertical Alignment (VA) technique is still one of the most popular techniques in the current LCD market. However, because liquid crystal molecules are aligned in the same direction (mono-domain vertical alignment), we also cannot see a normal image from the view angle perpendicular to or symmetric to the direction. No matter when the liquid crystal molecules are realigned in a different direction after the electrical field existing therein changes, the view angle is also limited to the parallel direction of the liquid crystal molecules. Therefore, a multi-domain VA technique was set forth to improve the drawback of the prior art, hence the quality of various view angles is assured. Japanese Fujitsu Corporation once tried to form ridges or bumps on the color filter, and use the oblique boundary generated by bumps to control the alignment of the tilt direction of liquid crystal molecules automatically align tilt direction according to where region their belong to. But because the existence of the bumps results in that the precise alignment between a color filter and an active matrix substrate is necessary, the yield of this LCD panel becomes worse and the cost thereof increases.

FIG. 1 is a cross-sectional diagram of a conventional LCD display panel with a bias-bending vertical alignment (BBVA) type. The LCD panel 10 comprises a color filter 11, a liquid crystal layer 12 and an active matrix substrate 13. The color filter 11 and active matrix substrate 13 have a transparent substrate 111 and 131 respectively. A main electric field exists between the common electrode 112 formed on the color filter 11 and the pixel electrode 134 formed on the active matrix substrate 13, and a pair of symmetrically oblique electric fields exists between a control electrode 133 and the pixel electrode 134 together formed on the active matrix substrate 13 to make liquid crystal molecules 121 have oblique positions. There is another insulation layer 132 interposed between the control electrode 133 and the pixel electrode 134.

But when $V_{CE}<V_{com}<V_P$ is satisfied, a declination line is brought into existence in the center of an area A, wherein $V_{CE}$, $V_{com}$ and $V_P$ represent the potentials of the control electrode, common electrode and pixel electrode respectively. The existence of the declination line results in that the liquid crystal layer 12 has a lower transmission ratio, a longer response time and an unstable status. In order to avoid the occurrence of these negative phenomena, it is expected that the following criteria should be satisfied during polarity inversion:

Criterion 1: If the current pixel is a positive frame, then $V_{CE}>V_P>V_{com}$; and Criterion 2: If the current pixel is a negative frame, then $V_{CE}<V_P<V_{com}$.

FIG. 2 is an equivalent circuit diagram of a pixel proposed by Korean Samsung Electronics Cooperation. The circuit of pixel 20 can satisfy aforesaid two criteria to eliminate declination lines. However, because each of the pixels 20 includes three thin film transistors, if one of the thin film transistors is damaged, the pixel is considered to be malfunctioning. Therefore, the manufacture yield of this LCD cannot meet an acceptable standard currently. On the other hand, the number of the thin film transistors connected to a same scanning line is too much so as to result in a severe RC delay on the scanning signal.

To improve the problems of the above-mentioned various wide view angle LCD devices, the application inventors have provided a kind of wide view angle LCD device set forth in US 2005/0083279. FIG. 3 is an equivalent circuit diagram of a pixel of this kind wide view angle LCD device. Only four adjacent pixels are shown in FIG. 3, which are formed by scanning lines 361, 362 and 363 (representing $G_{m-2}$, $G_{m-1}$ and $G_m$ respectively) crossing data lines 351, 352 and 353 (representing $D_{n-2}$, $D_{n-1}$ and $D_n$ respectively). Each pixel includes a first thin film transistor $T_1$, a second thin film transistor $T_2$, a control electrode 34 and a pixel electrode 33 for the pixel at the intersection of the data line 353 and scanning line 363. The first electrode of the first thin film $T_1$, is connected to a data line 353, the second electrode of it is connected to the pixel electrode 33, and the gate electrode of it is connected to a scanning line 363. The first electrode of the second thin film transistor $T_2$ is connected to another adjacent data line 352, the second electrode of it is connected to the control electrode 34, and the gate electrode of it is connected to another adjacent scanning line 362. In the pixel configuration, a liquid crystal capacitor $C_1$ is constituted between the pixel electrode 33 and a common electrode 37, a bias-bending capacitor $C_2$ is constituted between the control electrode 34 and the pixel electrode 33, and further a capacitor $C_3$ is constituted between the control electrode 34 and the common electrode 37.

Taking the pixel B which is at the intersection of the data line $D_n$ and the scanning line $G_m$ for example, the pixel B is controlled via its left and right side data lines 352 and 353 as well as its up and down side scanning lines 362 and 363. During the pixel operating process, the scanning signal of each scanning line during two adjacent horizontal scanning periods or a vertical scanning period includes a waveform which can make corresponding voltage to be written into the control electrode 34 or the pixel electrode 33, and a coupled voltage is induced on the control electrode 34 due to the potential variation of the pixel electrode 33 during the next horizontal scanning period. Through the above pixel configuration as well as the pixel operating method, when the polarity of the pixel is positive, Criterion 1 $V_{CE}>V_P>V_{com}$ is satisfied; and after a vertical scanning period terminating, while the polarity of the pixel changes to negative, Criterion 2 $V_{CE}<V_P<V_{com}$ is also satisfied accordingly. As FIG. 3 is shown, each pixel only comprises two thin film transistors ($T_1$ and $T_2$), therefore, the manufacture yield of this LCD and the pixel aperture ratio can be increased. On the other hand, since the number of the thin film transistors connected to a same scanning line is decreased, the RC delay problem of the scanning signal is improved.

However, as the pixel configuration of FIG. 3 shows, each pixel is controlled via its two adjacent data lines (the left and right side data lines) as well as its two adjacent scanning lines (the up and down side scanning lines), that is, each pixel must be electrically coupled to two data lines and two scanning lines. In other words, as a full pixel matrix is concerned, if a pixel matrix comprises n pixel columns and m pixel rows (i.e. a n×m pixel matrix) as shown in FIG. 4, the pixel matrix 400 will need n+1 data lines ($D_1$~$D_{n+1}$) and m+1 scanning lines ($G_1$~$G_{m+1}$) to drive each pixel thereof. That is to say, there must be two data lines, the first data line $D_1$ and the n+1 th data line $D_{n+1}$, respectively existing in the most left and right outsides of the pixel matrix 400, and two scanning lines, the first scanning line $G_1$ and the m+1 th scanning line $G_{m+1}$, respectively existing in the most up and down outsides of the pixel matrix 400. Nevertheless, as a n×m pixel matrix of a traditional panel is concerned, if each pixel in the traditional panel only has one thin film transistor, it generally needs only n data lines and m scanning lines to drive the pixels, therefore, a traditional source driver and a gate driver which can respectively provide n data signals for the n data lines and m scanning signals for the m scanning lines are usually employed.

However, since the pixel matrix 400 in FIG. 4 has n+1 data lines and m+1 scanning lines, it particularly needs to be associated with a source driver and a gate driver which can respectively provide n+1 data signals for the n+1 data lines and m+1 scanning signals for the m+1 scanning lines. In other words, the traditional source and gate drivers which can only respectively provide n data signals and m scanning signals can be no more employed, and a new designed source driver and a gate driver are currently needed. Taking the 1024×768 XGV panel for example, the traditional source driver employed in the panel only provides 1024 data signals, nevertheless, if the pixel matrix configuration of a XGV panel is designed as that in FIG. 4, a source driver which can provide 1025 data signals will be needed. However, as we known, to redesign a driver, especially a source driver, causes a lot of cost. Therefore, due to the above mentions, it is needed to provide an improved liquid crystal display panel and a driving method thereof according to the pixel matrix 400 being in FIG. 4 to resolve the aforesaid problems.

SUMMARY OF THE INVENTION

In order to achieve the foregoing objectives, the present invention discloses a liquid crystal display panel, which includes a plurality of scanning lines; a plurality of data lines for transmitting data signals; a pixel matrix having a plurality of pixels which are formed in the intersections of the scanning lines and the data lines; and each of the pixels having: a pixel electrode; a control electrode; a first thin film transistor having a gate electrode connected to the scanning line, a first electrode connected to the data line and a second electrode connected to the pixel electrode; a second thin film transistor having a gate electrode connected to another adjacent scanning line, a first electrode connected to another adjacent data line and a second electrode connected to the control electrode; and wherein one of the two most outside data lines of the pixel matrix is called a boundary data line, and an auxiliary line is disposed between the boundary data line and the pixel electrode adjacent to the boundary data line.

Further, the present invention discloses a driving method for a liquid crystal display, wherein the liquid crystal display panel comprises: a pixel matrix having n pixel columns and m pixel rows; a plurality of pixels which are formed in the intersections of n+1 data lines and m+1 scanning lines of the pixel matrix, wherein each the pixel is respectively coupled to its two adjacent data lines and two adjacent scanning lines, and one of the two most outside data lines of the pixel matrix is called a boundary data line, and an auxiliary line is disposed between its adjacent pixel electrode and the boundary data line, the method comprises the steps of: providing n data line signals respectively for the n+1 data lines, wherein the boundary data line and its non-adjacent data line together share one of the n data line signals; providing a auxiliary signal to the auxiliary line, wherein the auxiliary line and its adjacent pixel electrode constitute a first capacitor; and controlling the pixel through the data signals of the two adjacent data lines and the scanning signals of the two adjacent scanning lines for the pixel.

BRIEF DESCRIPTION OF THE DRAWINGS

The foregoing aspects and the attendant advantages of this invention will become more readily appreciated and better understood by referencing the following detailed description, when taken in conjunction with the accompanying drawings, wherein.

DESCRIPTION OF THE PREFERRED EMBODIMENT

The invention will be explained in detail in accordance with the accompanying drawings. It is necessary to illustrate that the drawings below could be simplified forms and not drawn in proportion to the real cases. Further, the dimensions of the drawings are enlarged for explaining and understanding more clearly.

Figure 1:
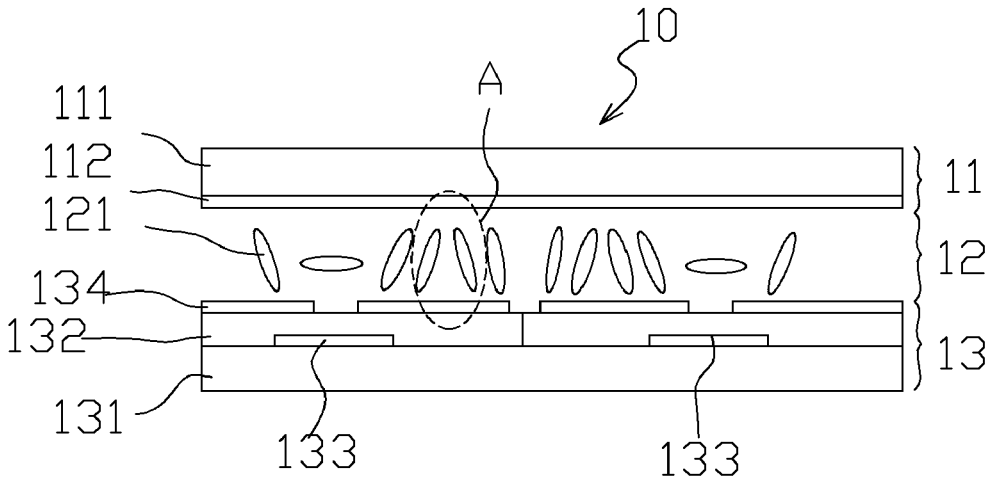
FIG. 1 (Background Art)
FIG. 1 is a cross-sectional diagram of a conventional LCD display panel with a bias-bending vertical alignment (BBVA) type.
Figure 2:
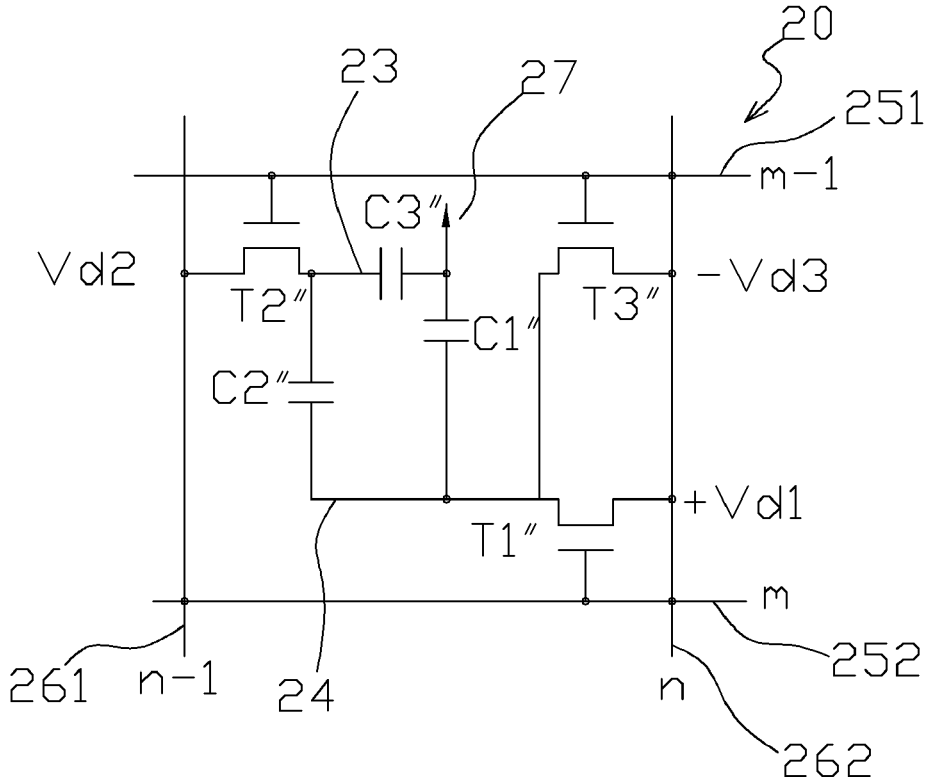
FIG. 2 (Background Art)
FIG. 2 is an equivalent circuit diagram of a pixel proposed by Korean Samsung Electronics Cooperation.
Figure 3:
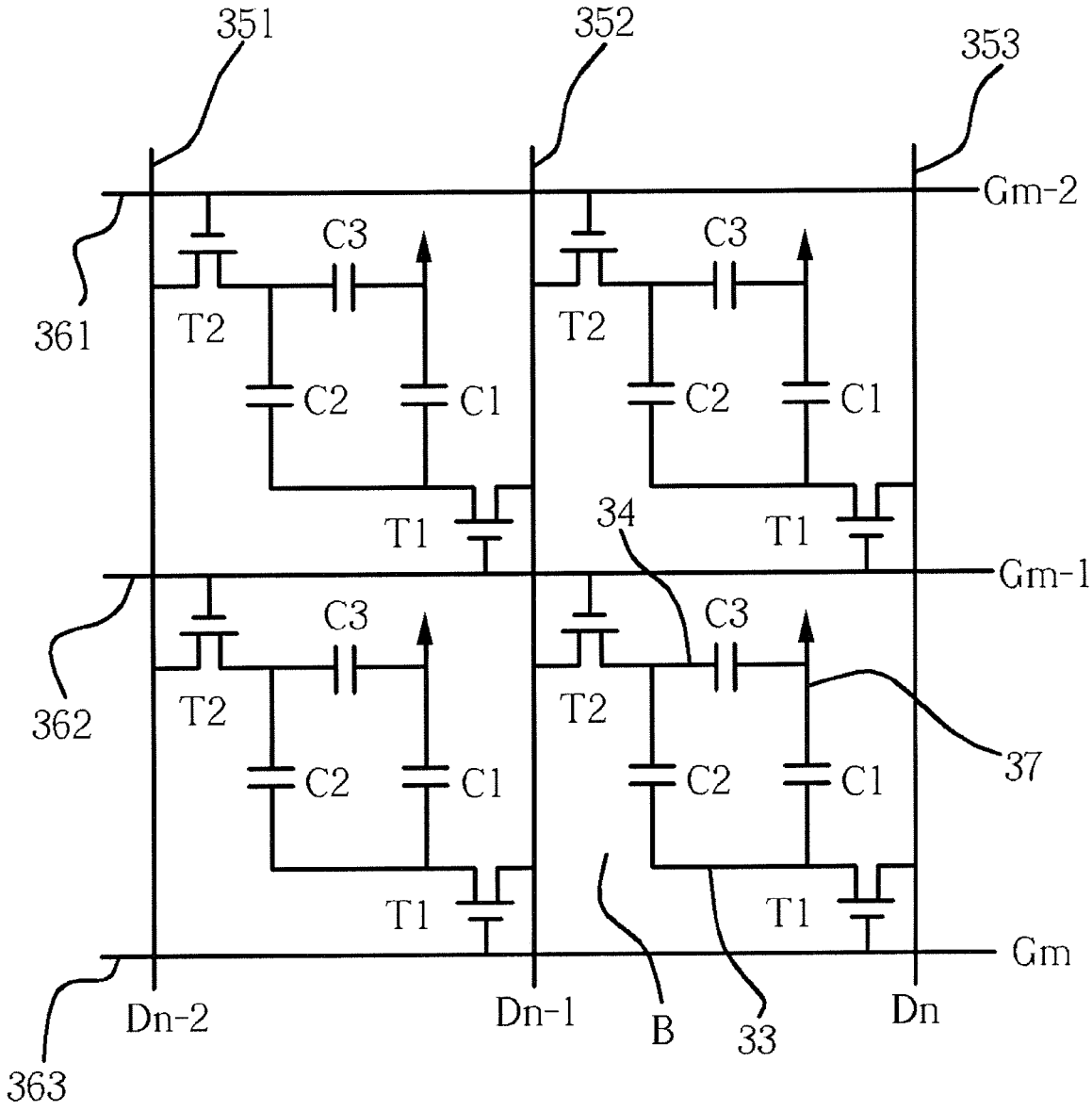
FIG. 3 is an equivalent circuit diagram of pixels of an LCD panel regarding to the present invention.
Figure 4:
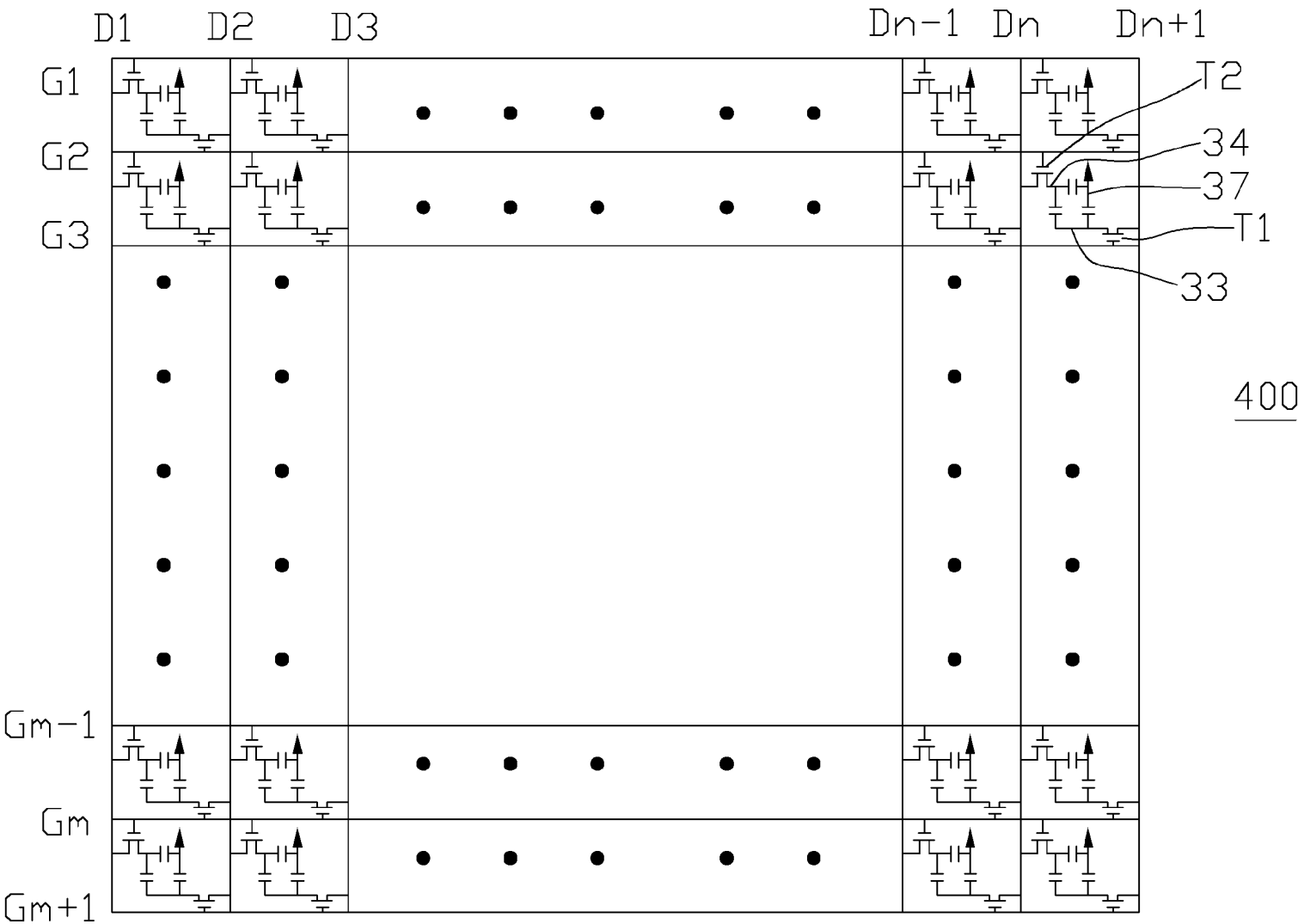
FIG. 4 is a pixel matrix diagram of an LCD panel regarding to the present invention.
Figure 5:
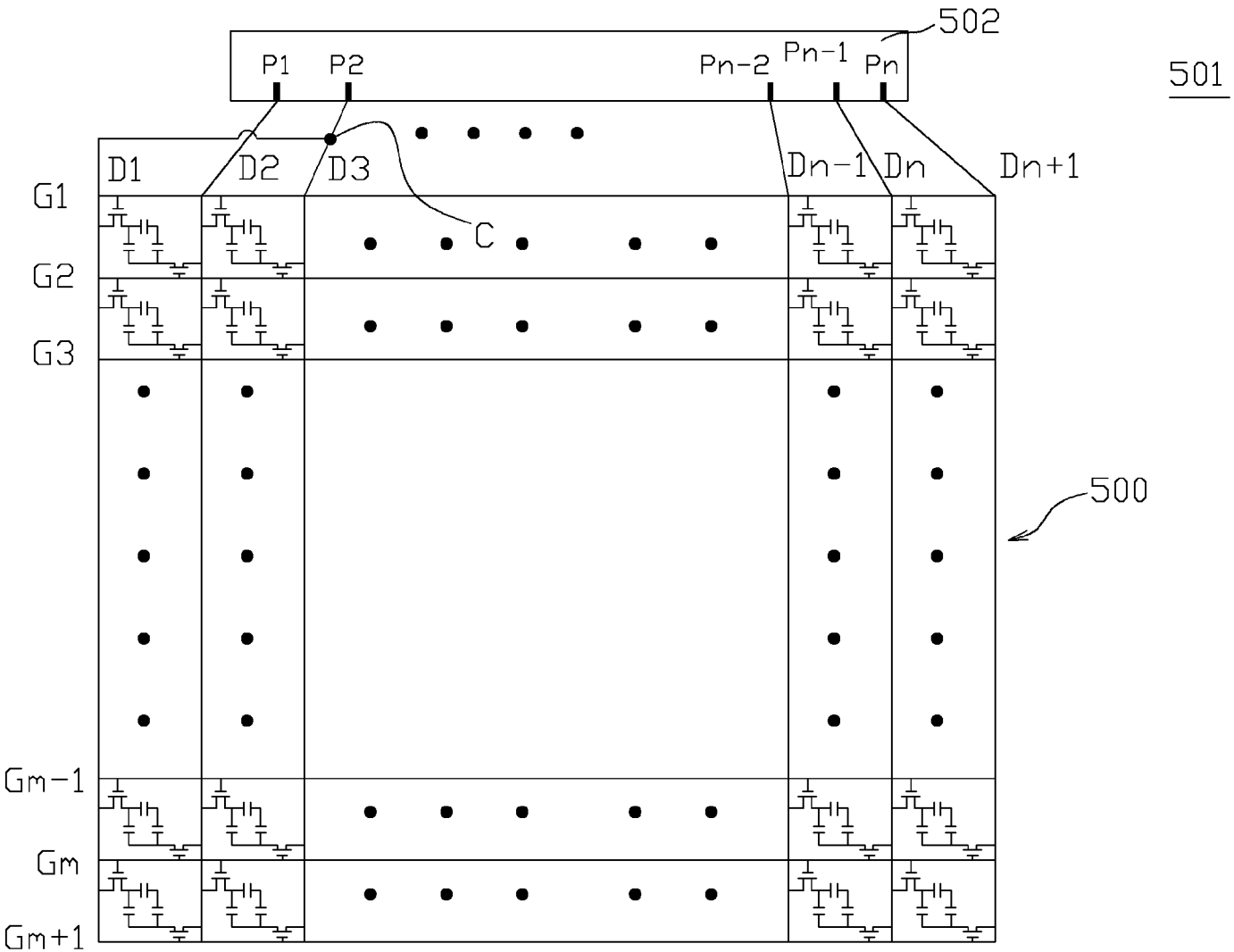
FIG. 5 illustrates a pixel matrix incorporating with a source driver of a LCD panel according to the first embodiment of the present invention.

FIG. 5 is an equivalent circuit diagram of a LCD panel in accordance with the first embodiment of the present invention. The LCD panel 501 comprises a n×m pixel matrix 500. The structure configuration of the pixel matrix 500 is similar to the pixel matrix 400 in FIG. 4, which has n pixel columns and m pixel rows. And all the pixels in the pixel matrix 500 are controlled via the n+1 data lines ($D_1$~$D_{n+1}$) and the m+1 scanning lines ($G_1$~$G_{n+1}$). The connecting ways among the thin film transistors and the capacitors in each pixel are the same with that in FIG. 4 and would not be explained again herein, and the same elements are indicated with similar numbers. In FIG. 5, a source driver 502 has n signal output pins ($P_1$~$P_n$) to transmit n data signals for the n+1 data lines of the pixel matrix 500. In order to resolve the problem that the number of the data signals of the source driver 502 can not match up the total number of the data lines, the present embodiment as shown in FIG. 5 makes the most left outside date line $D_1$, called a boundary data line, be electrically connected to an another data line which is not adjacent to the boundary data line (the date line $D_1$), such as electrically connected to the data line $D_3$, namely, the data signal of the boundary data line is provided via the data line $D_3$. By doing this, it will be only needed n data signals being provided for the n+1 data lines, and then a traditional source driver which provides n data signals can be employed again in the LCD panel, which a new designed source driver will not be needed any more. Further, the connecting way of the boundary data line in FIG. 5 can also make the displaying of the pixels in the first pixel column corresponding to the boundary data line satisfy the two above-mentioned criteria during the pixel operating process. How the connecting way in FIG. 5 achieves the objective that meets the two criteria as well as the driving method relating to the LCD panel 501 will be illustrated following.

Figure 6:
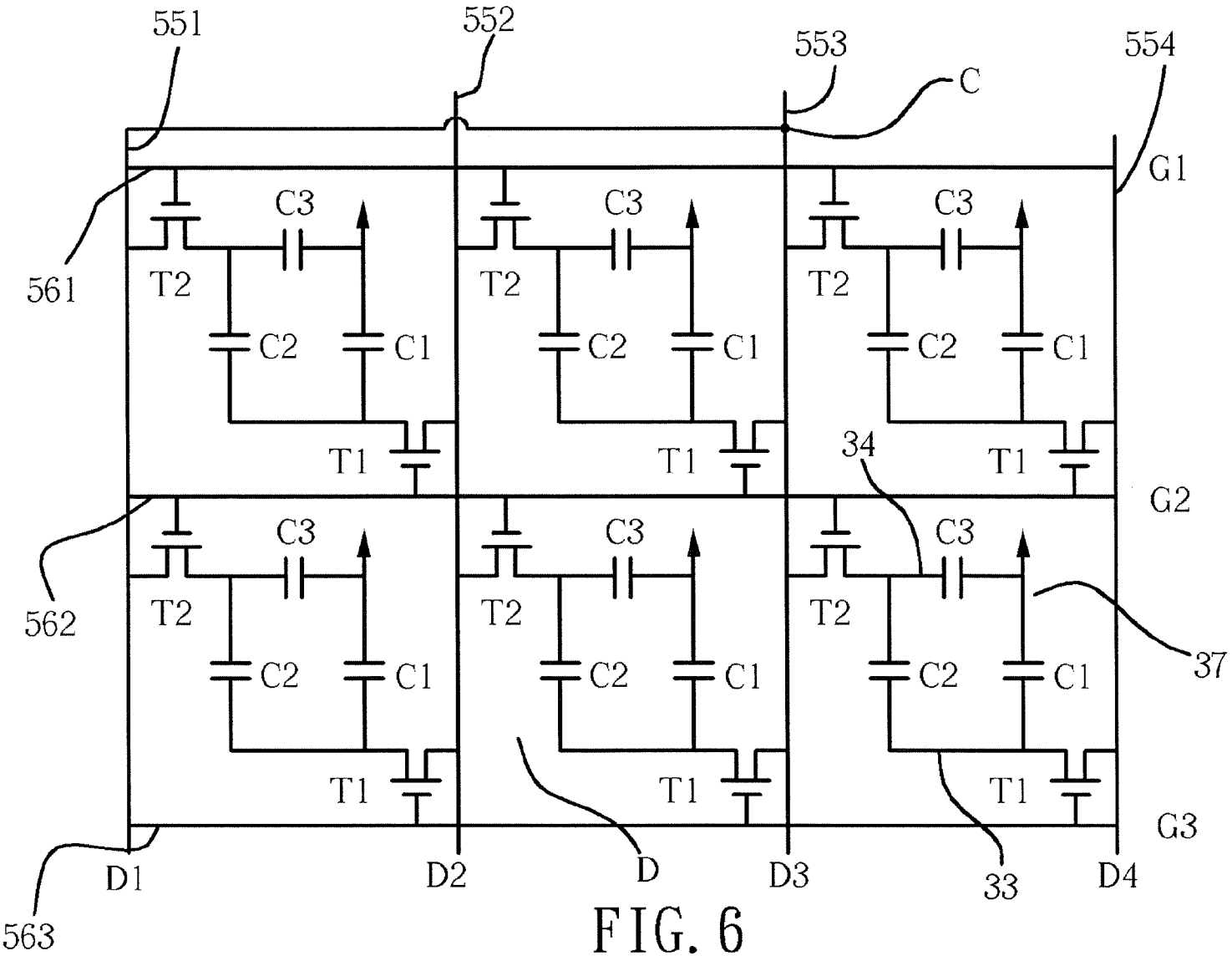
FIG. 6 illustrates a portion of the pixel structure configuration in FIG. 5.

FIG. 6 is a schematic drawing illustrating some adjacent pixels of the pixel matrix in FIG. 5, which is taken for example to explain the operating method of the LCD panel 501 according to the first embodiment. The six adjacent pixels are formed by scanning lines 561, 562 and 563 (representing $G_1$, $G_2$ and $G_3$ respectively) crossing data lines (representing $D_1$, $D_2$ and $D_3$ respectively), which comprise two pixels in the first pixel column and four pixels respectively in the second and third pixel columns. In FIG. 6, each pixel comprises a first thin film transistor $T_1$, a second thin film transistor $T_2$, a control electrode 34, a pixel electrode 33, a common electrode 37, a liquid crystal capacitor $C_1$, a bias-bending capacitor $C_2$ and a capacitor $C_3$, wherein the connecting ways among all the components in each pixel are the same as the aforesaid way.

Figure 7:
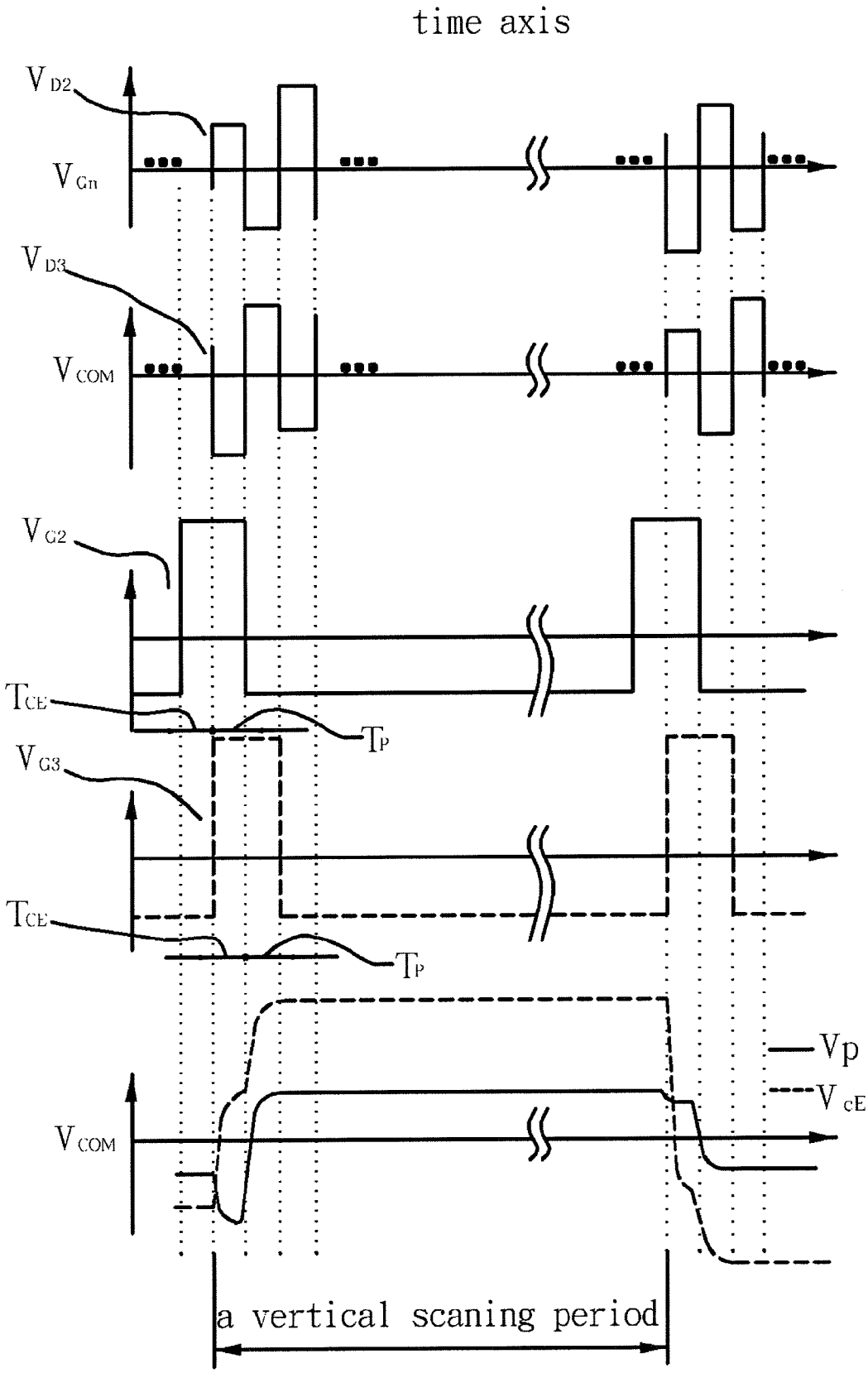
FIG. 7 illustrates a waveform diagram of driving signals applied to the pixel in FIG. 6.

Referring to FIG. 6, taking one pixel which is not in the first pixel column for example, i.e. the pixel D, and FIG. 7 is a waveform diagram of driving signals applied to the pixel D. $V_{D2}$ and $V_{D3}$ represent the data signals applied to the data lines 552 and 553, respectively, and $V_{G2}$ and $V_{G3}$ represent the scanning signals applied to the scanning lines 562 and 563, respectively. The scanning signal waveform during each vertical scanning period includes a first waveform in a $T_{CE}$ interval and a second waveform in a $T_P$ interval. The lowest waveform row in FIG. 7 is the variations of the corresponding potentials of the pixel D, wherein $V_P$ and $V_{CE}$ represent the potential of the pixel electrode 33 and control electrode 34, respectively.

Referring to FIG. 7, during the interval $T_P$ on the scanning signal $V_{G2}$, the second thin film transistor $T_2$ is turned on by the scanning signal $V_{G2}$, and then the data signal $V_{D2}$ is written into the control electrode 34. As shown in FIG. 7, the potential of the control electrode 34 changes from an initial potential (lower than $V_{com}$) to the same potential as the data signal $V_{D2}$ (higher than $V_{com}$). At the same interval, because the first thin film transistor $T_1$ is turned on by $V_{G3}$, the potential (lower than $V_{com}$) of the data signal $V_{D3}$ is written into the pixel electrode 33. During the succeeding interval $T_P$ on the scanning signal $V_{G3}$, the first thin film transistor $T_1$ is turned on by the scanning signal $V_{G3}$, and then the potential (higher than $V_{com}$) of the data signal $V_{D3}$ is written into the pixel electrode 33. Meanwhile, because the second thin film transistor $T_2$ is turned off, the control electrode 34 is in a floating state. Sequentially, the potential of the control electrode 34 is advanced to a higher level due to a coupling voltage via a capacitive coupled effect.

From FIG. 7, it is clear that when the polarity of the pixel is positive, Criterion 1 $V_{CE}>V_P>V_{com}$ is satisfied. After the vertical scanning period terminating, because the polarity of the pixel changes to negative, Criterion 2 $V_{CE}<V_P<V_{com}$ is also satisfied accordingly, as FIG. 7 shows. Therefore, the pixel configuration of FIG. 6 cooperating with the driving waveform provided in FIG. 7 will make each pixel satisfy Criterion 1 $V_{CE}>V_P>V_{com}$ and Criterion 2 $V_{CE}<V_P<V_{com}$ during pixel operating process to eliminate the disclination problem. However, the driving waveform for the pixel of the present invention is not limited to that in FIG. 7, whatever can make the pixel satisfy the two criteria is also appropriate. In addition, taking the pixel D for example, it is also noted that the potential of the pixel electrode 33 is provided by the data signal $V_{D3}$, which is used to display the demanded picture, thus, preciseness of the value of the data signal $V_{D3}$ for the pixel electrode 33 is strictly demanded; while the potential of the control electrode 34 is provided by the data signal $V_{D2}$, which is used to produce a bias-bending electronic field for liquid crystal. Since the main purpose of the potential of the control electrode 34 is to produce a bias-bending electronic field, the preciseness of the value of the control electrode 34 is not demanded so strictly as that of the pixel electrode 33. Thus, generally, the main demand for the potential of the control electrode is to lead the polarity of the control electrode to be opposing to that of the pixel electrode (as shown in FIG. 7), namely, to lead the pixel operation to satisfy the two criteria. Similarly, as FIG. 6 illustrates, when operating the pixels of the first pixel column, the polarities of the two data signals respectively provided via the two data lines $D_1$ (the boundary data line) and $D_2$ being respectively located at the left and right sides of the first pixel column must be opposite to each other. Namely, the data line $D_3$, which is connected to the boundary data line must provide a signal having a polarity opposing to the polarity of the data line $D_2$. Besides, as the aforesaid, since the preciseness of the value of the control electrode 34 is not demanded so strictly as that of the pixel electrode 33, in the embodiment, the potential of the control electrode 34 is provided via other data line not being directly coupled to it (i.e. the potential of the data line D, is provided via the data line $D_3$.) However, in another embodiment, it is not excluded that the potential of the pixel electrode 33 is also provided via other data line not being directly coupled to it.

Figure 8:
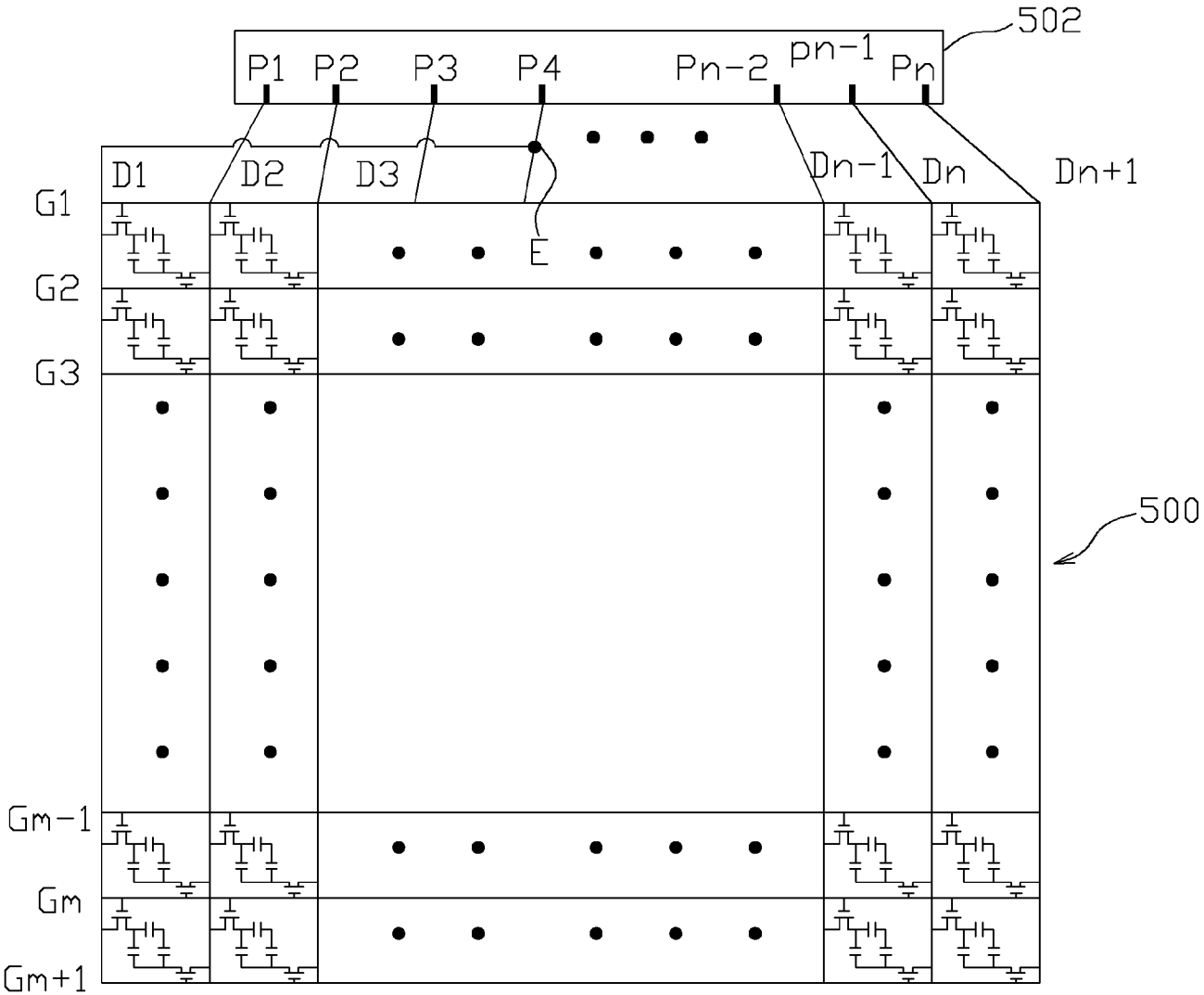
FIG. 8 illustrates a pixel matrix of another embodiment according to the first embodiment of the present invention.

Generally, in order to solve the cross talking or flicker problems of a LCD panel, one of the inversion driving methods including the frame inversion, the row inversion, the column inversion and the dot inversion driving method, is usually employed in a panel. Of the inversion driving methods, the dot inversion driving method is the most often used, and one of the features of the dot inversion driving method is the polarities of any two adjacent data lines of a panel are opposing to each other. Hence, if the LCD panel shown in the FIG. 5 or FIG. 6 is operated under the dot inversion driving method, the polarities of the data line $D_2$ and $D_3$ will be opposing to each other. Therefore, as FIG. 5 shows, making the boundary data line (the data line $D_1$) be connected to the data line $D_3$ at the connecting point C will lead the boundary data line to acquire a potential opposing to that of the data line $D_2$. Furthermore, due to the interval between the boundary data line and the data line $D_3$ is the shortest one, the boundary data line is preferably connected to the data line $D_3$, which can not only save the material of the conductive line but also reduce the signal delay problem. However, it should be noted that the boundary data line is not limited to be connected with the data line $D_3$, it also can be connected to other data line which provides a data signal whose polarity is opposing to that of the data line $D_2$. For instance, in another embodiment, as shown in FIG. 8, the boundary data line is connected to the data line $D_5$ at a connecting point E. Additionally, although the connecting point C of the boundary data line and the data line $D_3$ in FIG. 5 is placed outside the pixel matrix 500, the location of the connecting point C, however, is not limited in the present invention, it can also be placed at any location inside the pixel matrix 500.

In addiction, referring to FIG. 5, the panel is corresponding to m+1 scanning lines, which also requires m+1 scanning signals to drive the pixels in the panel, namely, the traditional gate driver which only provides m scanning signals can not be employed any more. However, since the circuit configuration design of a gate driver is generally much easier than that of a source driver, the cost of redesigning a gate driver would be much cheaper than redesigning a source driver. Hence, in the present invention, it is recommended to redesign a gate driver matching up the m+1 scanning lines to provide m+1 scanning signals, and the present invention will mainly focus on the providing way concerning the data signals of the panel. However, in fact, in another embodiment, the providing way of the data signals presented in the present invention can also be applied in the providing way concerning the scanning signals.

Figure 9:
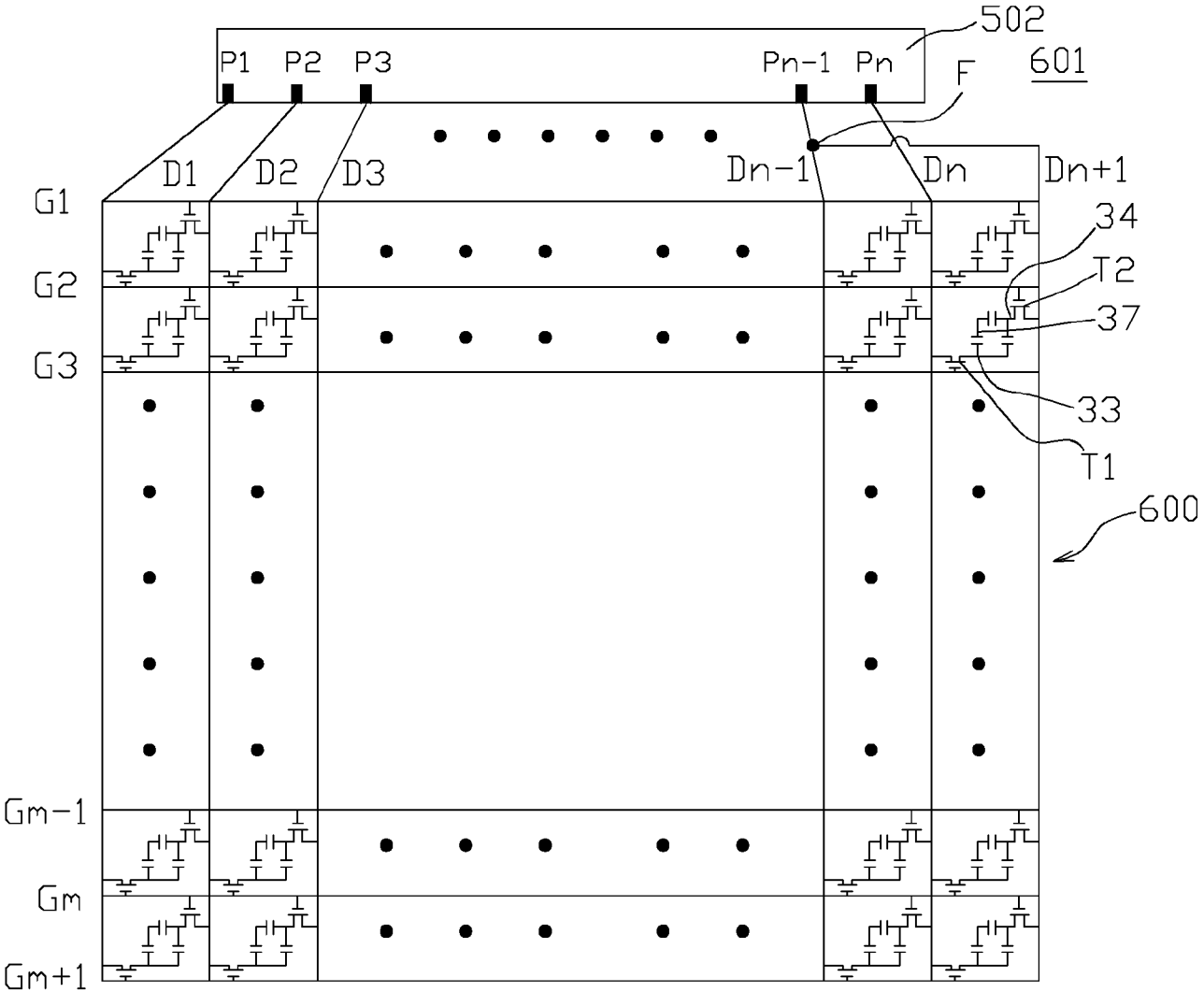
FIG. 9 illustrates a pixel matrix of another embodiment according to the first embodiment of the present invention.

In accordance with the first embodiment in FIG. 5, the data line $D_1$ being located at the most left side of the pixel matrix 500 is defined as a boundary data line, and it is electrically connected to the data line $D_3$ at the point C that both the data signals of the boundary data line and the data line $D_3$ will be provided via the output pin $P_2$ of the source driver 502. By doing this, in the pixel matrix 500, n+1 data signals from the source driver are no longer required and only n data signals are required now. That is, the traditional source driver now can content the driving demand of the pixel matrix 500 with providing the required data signals. Similarly, in another embodiment as shown in FIG. 9, instead of the data line $D_1$, the data line $D_{n+1}$ being located at the most right side of the pixel matrix 600 is defined as a boundary data line, and it is electrically connected to its non-adjacent data line $D_{n-1}$ at the point F or connected to any other data line which can provide a data signal whose polarity is opposing to that of the data line $D_n$; then, the traditional source driver will also content the driving demand of the pixel matrix 600. As for the driving waveforms for the data lines and scanning lines in the pixel matrix 600 as well as the driving method thereof, they are totally similar with that of the first embodiment in the FIG. 7, and here would not be repeated. However, it should be specially knew that, in order to match up the connecting way in FIG. 9 which makes the data line $D_{n-1}$ and $D_{n+1}$ electrically connect together, the connecting ways among the elements of each of the pixels in FIG. 9 are reversed in the left-right sides comparing to that in the FIG. 5. That is, taking one of the pixels in the last pixel column (the n+1 pixel column) for instance, the second transistor $T_2$ is connected to the boundary data line (the data line $D_{n+1}$) and located at the right side of the pixel, and the first transistor $T_1$ is connected to the data line $D_n$ and located at the left side, hence, the voltage of the control electrode 34 can be acquired through electrically connecting the boundary data line with the data line $D_{n-1}$.

Figure 10:
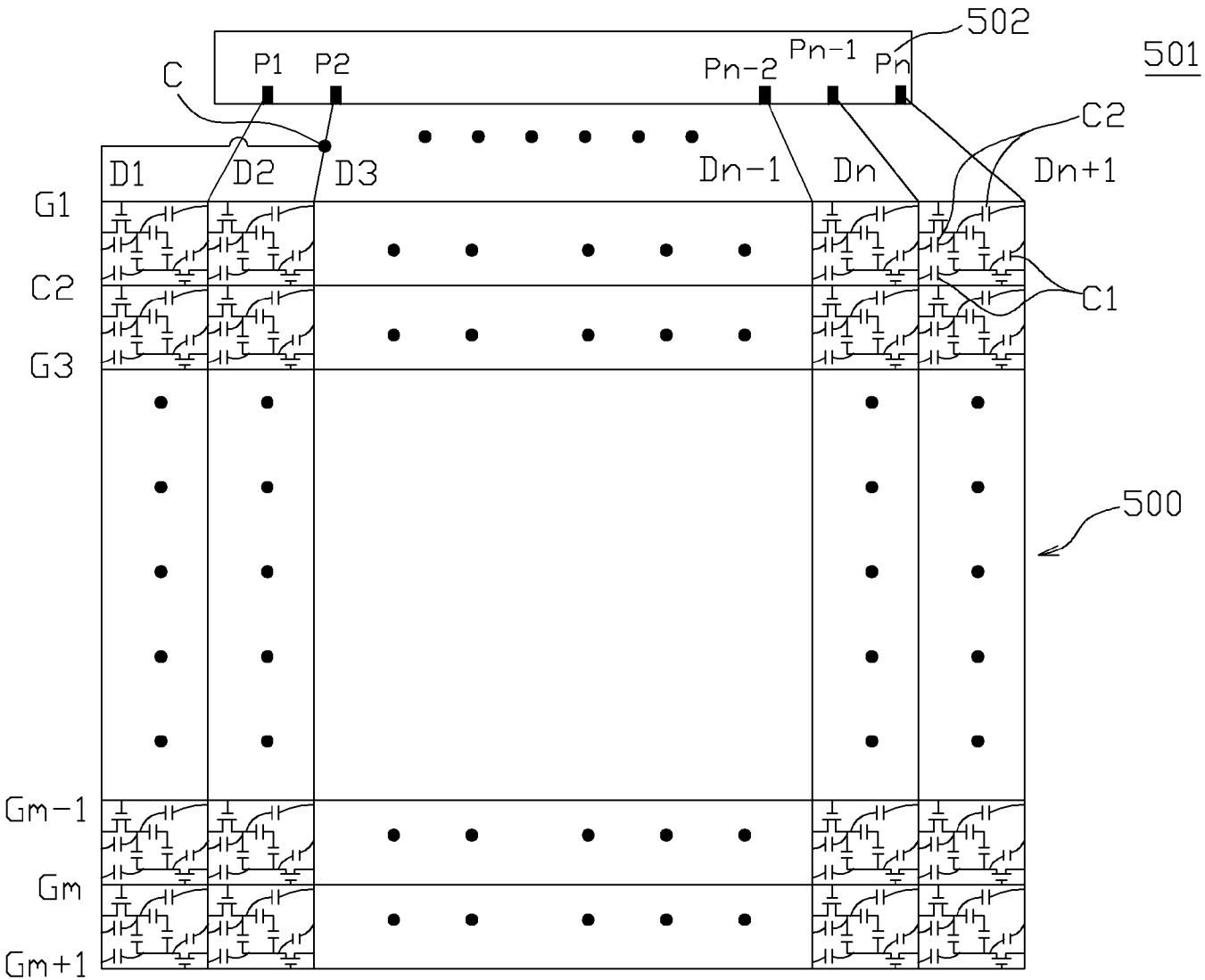
FIG. 10 illustrates a schematic diagram of the parasitic capacitors produced in the pixel matrix in FIG. 5 during the pixel operating process.

However, as FIG. 10 shows, during the operating process for displaying the panel in FIG. 5, a parasitic capacitor $C_1$ will be produced between the pixel electrode 33 of each pixel of each pixel column and its adjacent data lines, and a parasitic capacitor $C_2$ will be produced between the control electrode 33 of each pixel of each pixel column and its adjacent data lines. Nevertheless, as FIG. 10 shown, as a m×n pixel matrix is concerned, each pixel column includes m pixels, and since a parasitic capacitor $C_1$ and $C_2$ will be respectively produced between each data line and its adjacent pixel electrode 33 as well as control electrode 34, each output pin of the source driver 502 will be usually coupled to one date line which is respectively coupled to 2m $C_1$ and 2m $C_2$. However, because the output pin $P_2$ is coupled to not only the data line $D_3$ but also the boundary data line, the output pin $P_2$ will be coupled to 3m $C_1$ and 3m $C_2$. Hence, the total value of the parasitic capacitors to which the output pin $P_2$ is coupled will be larger than other output pins.

Figure 11A:
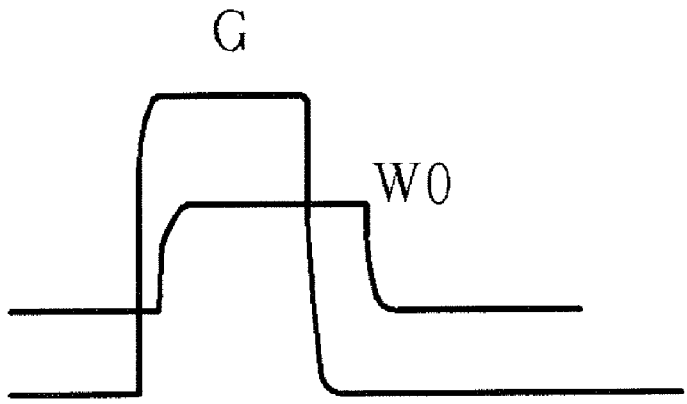
FIG. 11 illustrates a schematic waveform figures for indicating the signal delay phenomenon in the data lines according to the first embodiment in FIG. 5.
Figure 11A:
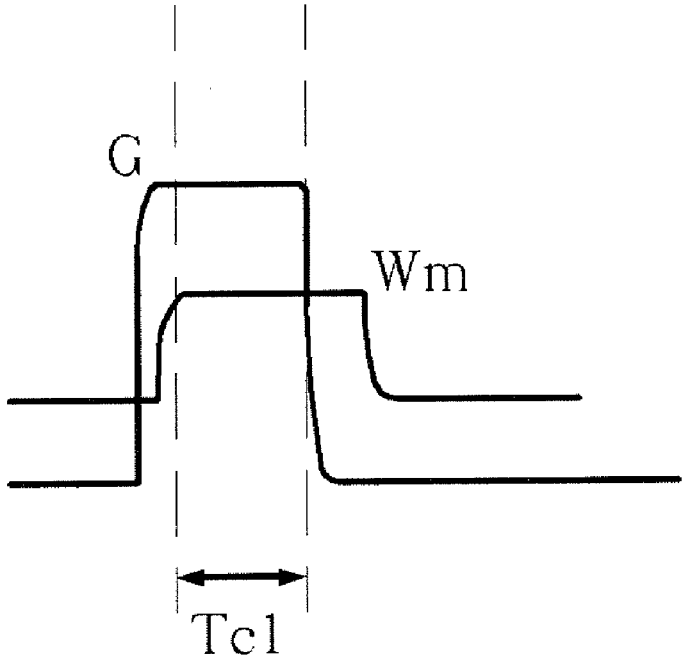

Thus, during the operating process for displaying the panel, the total loading of the capacitors to which the output pin $P_2$ is corresponding will be much larger than other output pins, and that will make the output signal from the output pin $P_2$ be severely delayed during the transmitting process. For example, comparing the data signal transmitting status in the data line $D_2$ with that in the boundary data line, FIGS. 11*a* and 11*b* respectively shows schematic waveform figures for indicating the signal delay phenomenon in the date line $D_2$ and the boundary line in accordance with the first embodiment. In FIG. 11*a*, G represents a scanning signal waveform of a corresponding scanning line. $W_0$ represents an original waveform outputting from the output pin $P_1$ and it will be respectively received by the pixels in the corresponding pixel column through the data line $D_2$ cooperating with the driving of the corresponding scanning lines. However, the effect of the parasitic capacitors on the data line $D_2$ will make the data signal transmitted therein cause RC delay, and that will lead the terminal pixel of the corresponding pixel column to receive a deformed signal waveform, such as $W_m$, namely, the effective charging time of the terminal pixel will be reduced to $T_{C1}$. Similarly, in FIG. 11*b*, $W_0$ represents an original waveform outputting from the output pin $P_2$. However, because the total value of the parasitic capacitors to which the output pin $P_2$ coupled are much larger than other output pins, the RC delay problem will be more severe in the boundary data line and the data line $D_3$ to which the output pin $P_2$ coupled. Hence, the waveform $W_m$ received by the terminal pixel of the corresponding pixel column in FIG. 11*b* will be deformed more severely than that in FIG. 11*a* and the effective charging time $T_{C2}$ will be shorter than $T_{C1}$, which leads to insufficient charging time and affects the quality of the display.

Figure 11B:
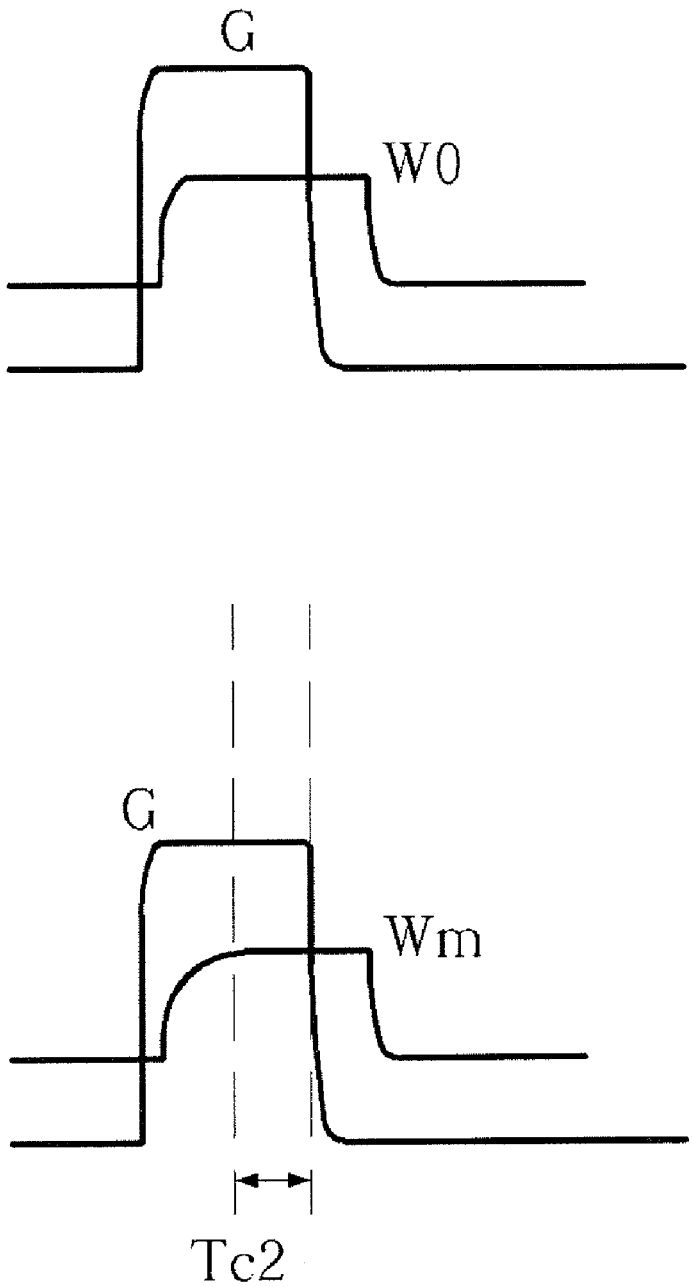
Figure 12:
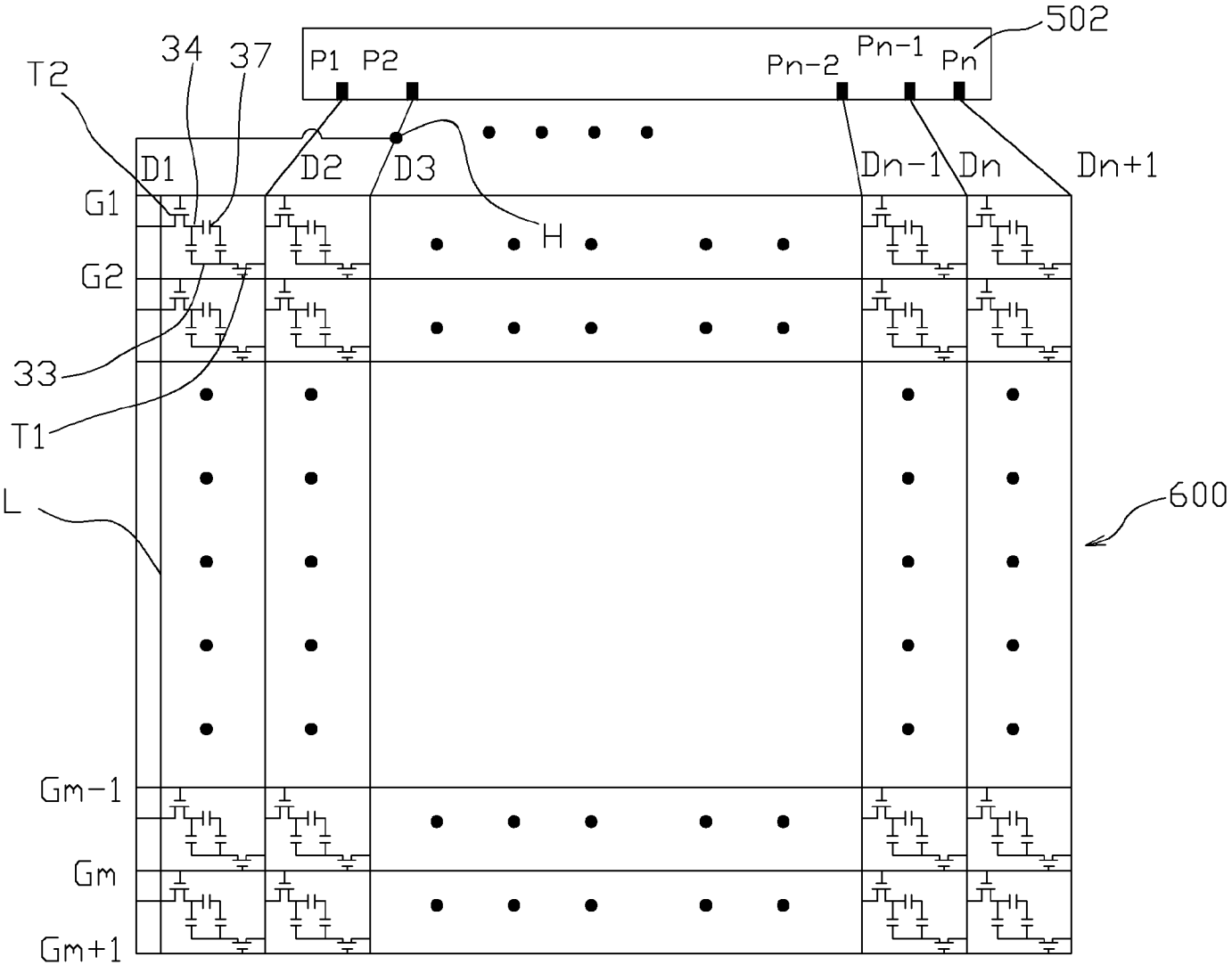
FIG. 12 illustrates a pixel matrix incorporating with a source driver of a LCD panel according to the second embodiment of the present invention.
Figure 13:
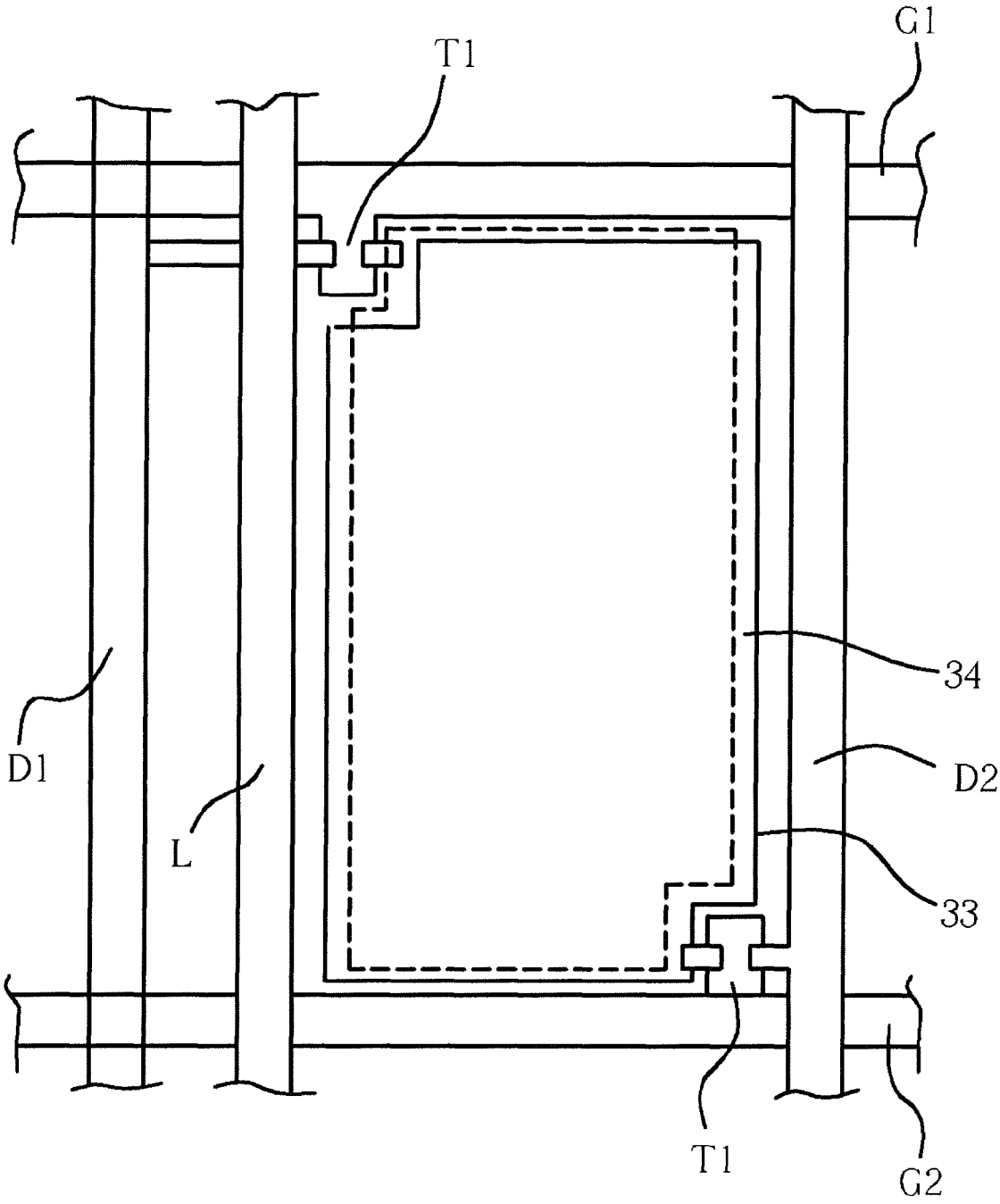
FIG. 13 illustrates a pixel structure configuration in FIG. 12.

In order to resolve the signal delay problem of the boundary data line and the data line $D_3$, as shown in FIG. 11*b*, the invention further provides an improved panel structure, as shown in FIG. 12, based on the first embodiment in FIG. 5. FIG. 12 illustrates the second embodiment according to the present invention, its structure is almost similar to that of FIG. 5, and the same elements are indicated with similar numbers; the main difference between the two embodiments is, in the second embodiment, an auxiliary line L is additionally disposed in each of the pixels in the first pixel column (the most left side pixel column) of the pixel matrix 600. The auxiliary line L is located between the boundary data line and the thin film transistor $T_2$ adjacent to the boundary data line. Preferably, the auxiliary line L is disposed between the boundary data line and the pixel electrode 33 as well as the control electrode 34 adjacent to the boundary data line, as shown in FIG. 13. FIG. 13 is a schematic drawing illustrating the pixel structure in the first pixel column, but not used to limit the pixel structure, any pixel structure which has the same equivalent circuit of the pixel in FIG. 12 is also suitable. In FIG. 13, in the pixel structure of the first pixel column, the auxiliary line L is disposed in between the boundary data line (the data line $D_1$) and the pixel electrode 33 as well as the control electrode 34. Preferably, the auxiliary line L is substantially parallel with the pixel electrode 33 and the control electrode 34. The auxiliary line L can be a floating line or connected with a time variable signal or a time invariable signal, wherein the time invariable signal can be a constant positive polarity signal, such as a common voltage of the display panel.

Figure 14:
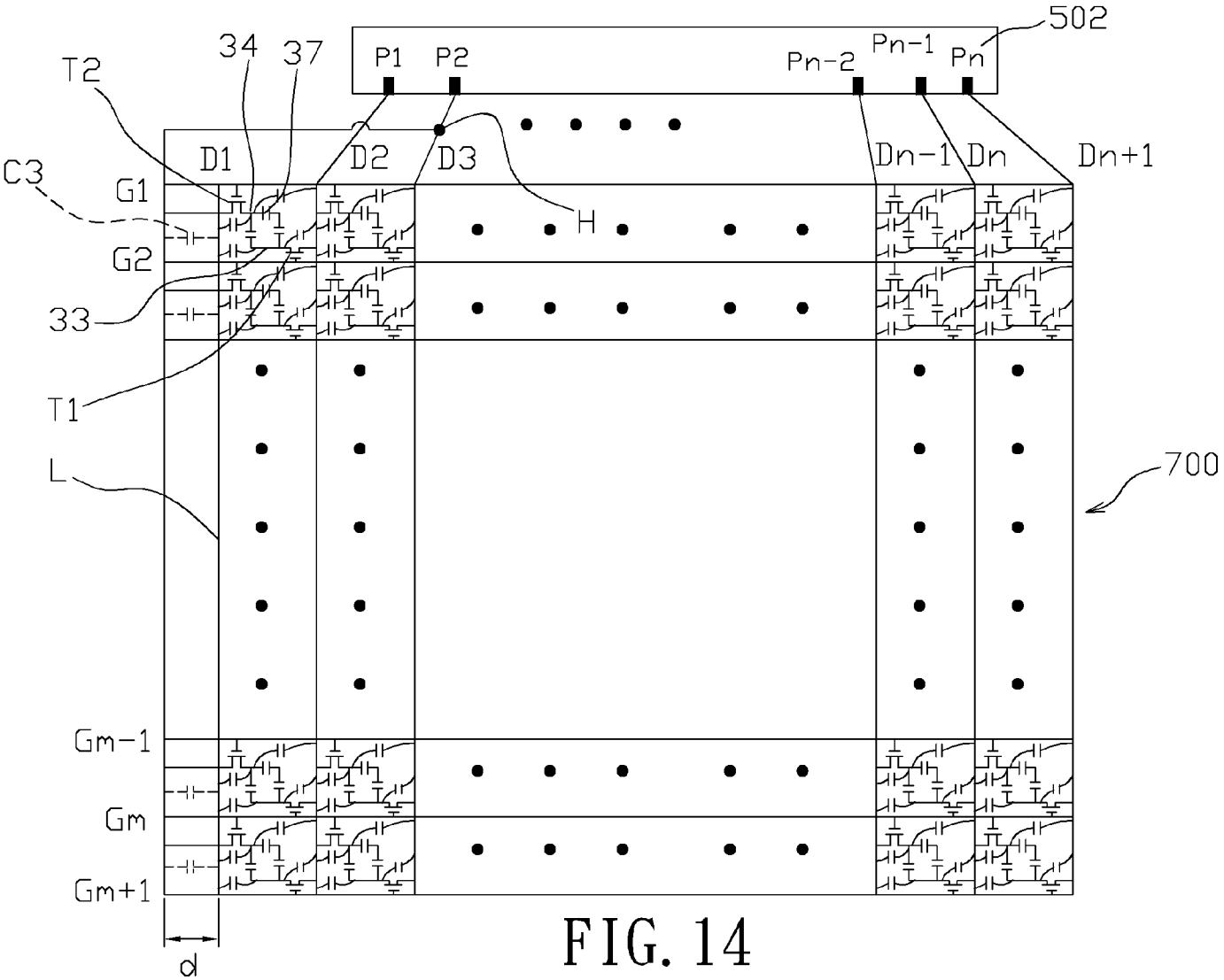
FIG. 14 illustrates a schematic diagram of the parasitic capacitors produced in the pixel matrix in FIG. 12 during the pixel operating process.

Similarly, during the operating process for displaying the pixel of the panel in FIG. 12, a parasitic capacitor $C_1$ and a parasitic capacitor $C_2$ will be respectively produced between the auxiliary line L and the pixel electrode 33 as well as the control electrode 34, as shown in FIG. 14. Through disposing the auxiliary line L, it would be avoided to produce the parasitic capacitors between the boundary data line and the pixel electrode as well as the control electrode; that is, the boundary data line will be no more coupled to the parasitic capacitors $C_1$ and $C_2$, which can greatly reduce the capacitor loading of the boundary data line. However, as the FIG. 14 is shown, if the interval between the auxiliary line L and the boundary data line is too small, an another parasitic capacitor $C_3$ (as the dotted line shows) will be accordingly produced between the auxiliary line L and the boundary data line, and the parasitic capacitors $C_3$ will also increase the capacitor loading to the boundary data line, which eventually still can not improve the RC delay problem causing from the capacitor loading. Thus, in designing the location of the auxiliary line L, the interval between the auxiliary line L and the boundary data line must be kept at an appropriate distance d, as shown in FIG. 14. And in order to avoid the distance d to be too small, preferably, the principle for designing the distance d is to make the value of the parasitic capacitor $C_3$ be much smaller than that of the parasitic capacitors $C_1$ and $C_2$.

Figure 15:
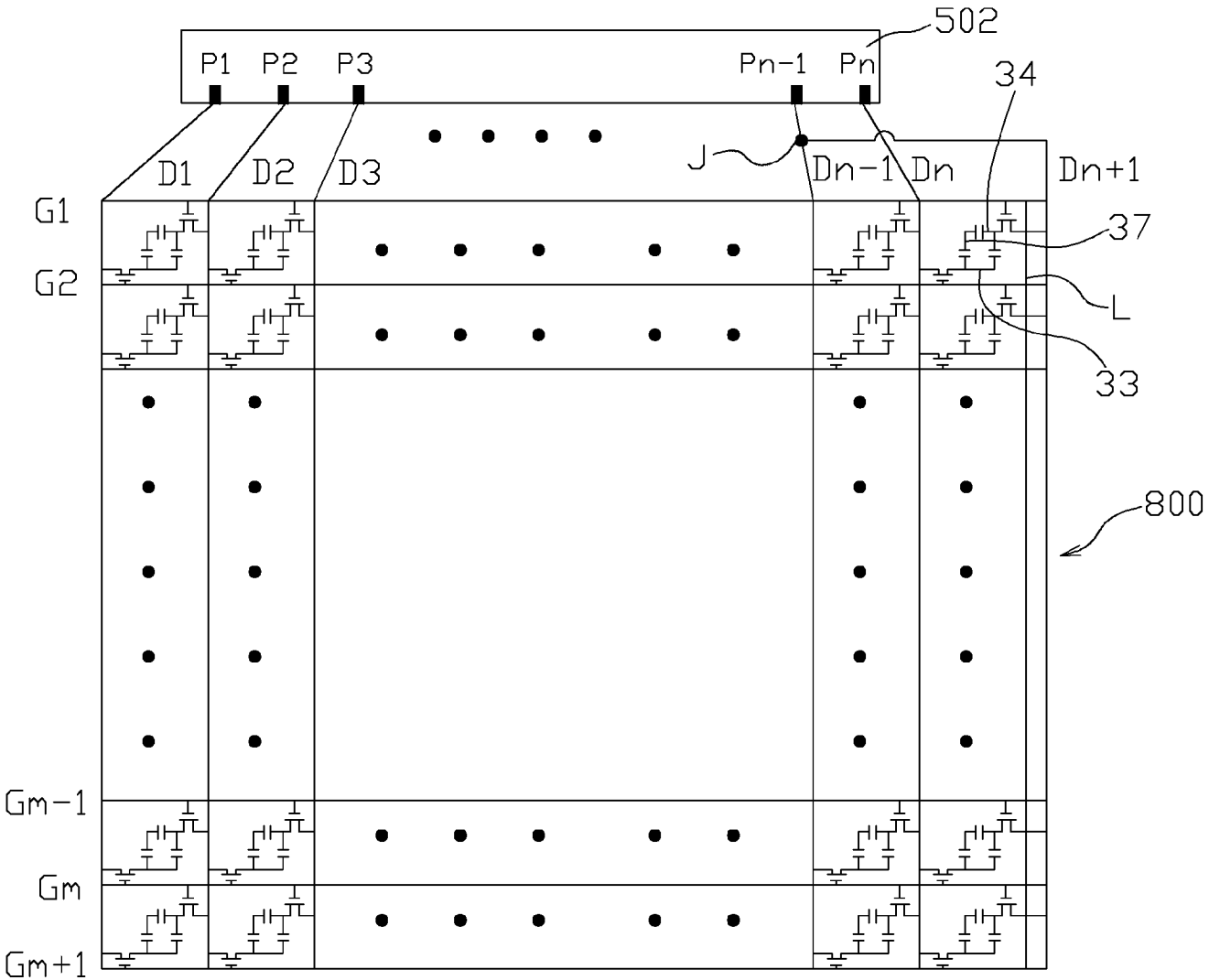
FIG. 15 illustrates a pixel matrix of another embodiment according to the second embodiment of the present invention.

As the above mentions, since the interval between the auxiliary line L and the boundary data line keeps at an appropriate distance d, the parasitic capacitor $C_3$ can be neglected comparing to the parasitic capacitor $C_1$ and $C_2$. Comparing FIG. 14 with FIG. 10, the boundary data line in FIG. 14 is not coupled to the parasitic capacitors $C_1$ and $C_2$, no more and the capacitor loading in the data lines coupled to the output pin $P_2$ can be greatly decreased to improve the signal delay problem shown in FIG. 11*b*. From FIG. 14, the auxiliary line L has the following two main functions: (1) isolating the boundary data line form its adjacent pixel electrode and control electrode by a appropriate distance to eliminate the parasitic capacitors $C_1$ and $C_2$ therebetween. (2) producing a parasitic capacitor $C_1$ and a parasitic capacitor $C_2$ between the auxiliary line L and the pixel electrode as well as the control electrode to make the parasitic capacitors at the left and right sides within each the pixel in the first pixel column be symmetric to each other to avoid the unbalance luminance between the first pixel column and other pixel columns. However, in another embodiment, in order to make the pixel structure design simply and improve the RC delay problem as well, an another design way is only broadening the interval between the boundary data line and the pixel electrode as well as the control electrode without additionally disposing an auxiliary line L to suppress the producing of the parasitic capacitor therebetween. However, as the above descriptions, although the design way which only broadens the interval can also improve the RC delay problem but it can not make t the parasitic capacitors respectively at the left and right sides within each the pixel of the first pixel column be symmetrical and then further affects the displaying quality. Besides, similarly, as the above mentions, in another embodiment, instead of the data line $D_1$, it can also take the data line $D_{n+1}$ as a boundary data line as described in FIG. 9, and subsequently, an auxiliary line L can also be additionally disposed in the last pixel column (the n+1th pixel column) as eventually shown in FIG. 15.

Figure 16:
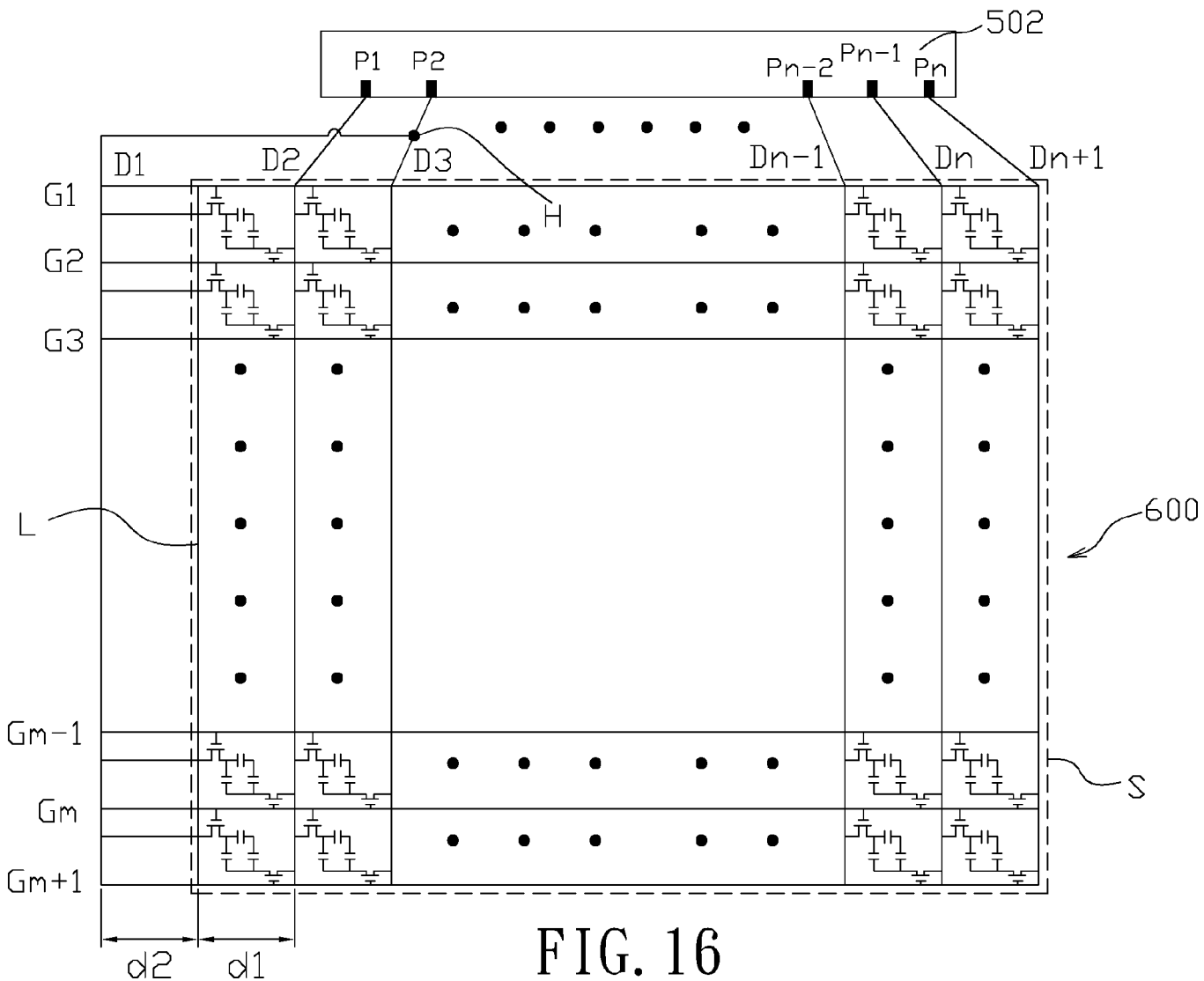
FIG. 16 illustrates a pixel matrix incorporating with a source driver of a LCD panel according to the third embodiment of the present invention.

In the embodiment of FIG. 12, the area of the full n×m pixel matrix 600 can also be defined as a display area, However, since the interval between the boundary data line and the auxiliary line L must maintain an appropriate distance d, in another embodiment, we can directly dispose the boundary data line outside the display area to broaden the interval between the auxiliary line L and the boundary data line, as shown in FIG. 16. FIG. 16 shows the third embodiment of the present invention, wherein the area marked by dotted line indicates an display area S, and the boundary data line is disposed outside the display area S. Referring to FIG. 16 again, the full pixel matrix 600 is composed of n+1 data lines and m+1 scanning lines to form a n×m matrix, wherein the first pixel column is divided into two sub-pixel column, a first sub-pixel column with a width $d_1$ and a second sub-pixel column with a width $d_2$. The first sub-pixel column is located inside the display area S and comprises the pixel electrode 33 and the control electrode 34 to display the pixel; and the second sub-pixel column is located outside the display area S. The auxiliary line L is located in the first sub-pixel column, however, in another embodiment, both the auxiliary line L and the boundary data line can also be located in the second sub-pixel column. And in another embodiment, the first sub-pixel column is the area which is defined by the auxiliary line L and the data line $D_2$, and the second sub-pixel column is the area which is defined by the boundary data line and the auxiliary line L, and that is, the display area S is defined by the auxiliary line L and the data line $D_{n+1}$.

Figure 17:
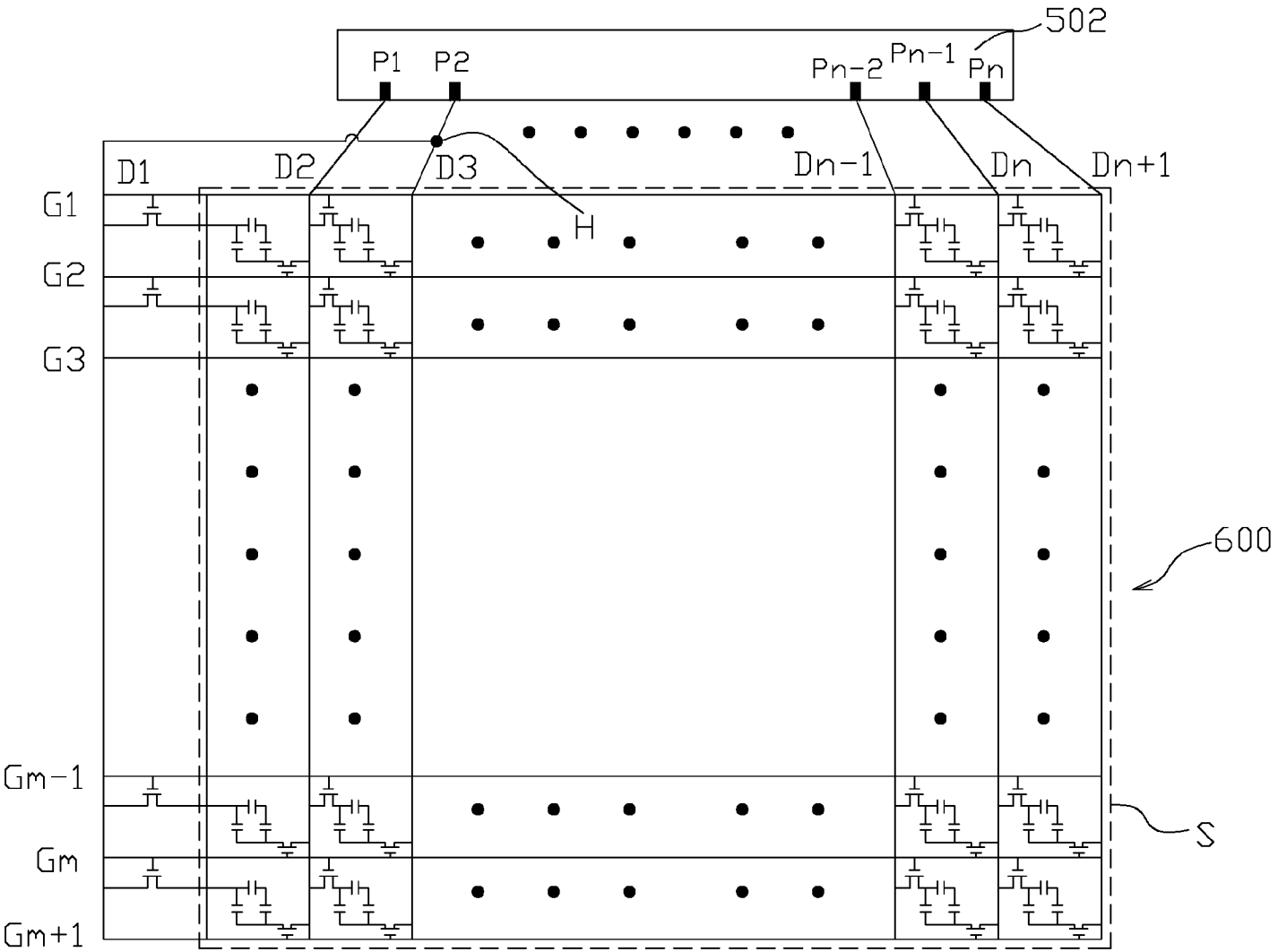
FIG. 17 illustrates a pixel matrix of another embodiment according to the third embodiment of the present invention.
Figure 18:
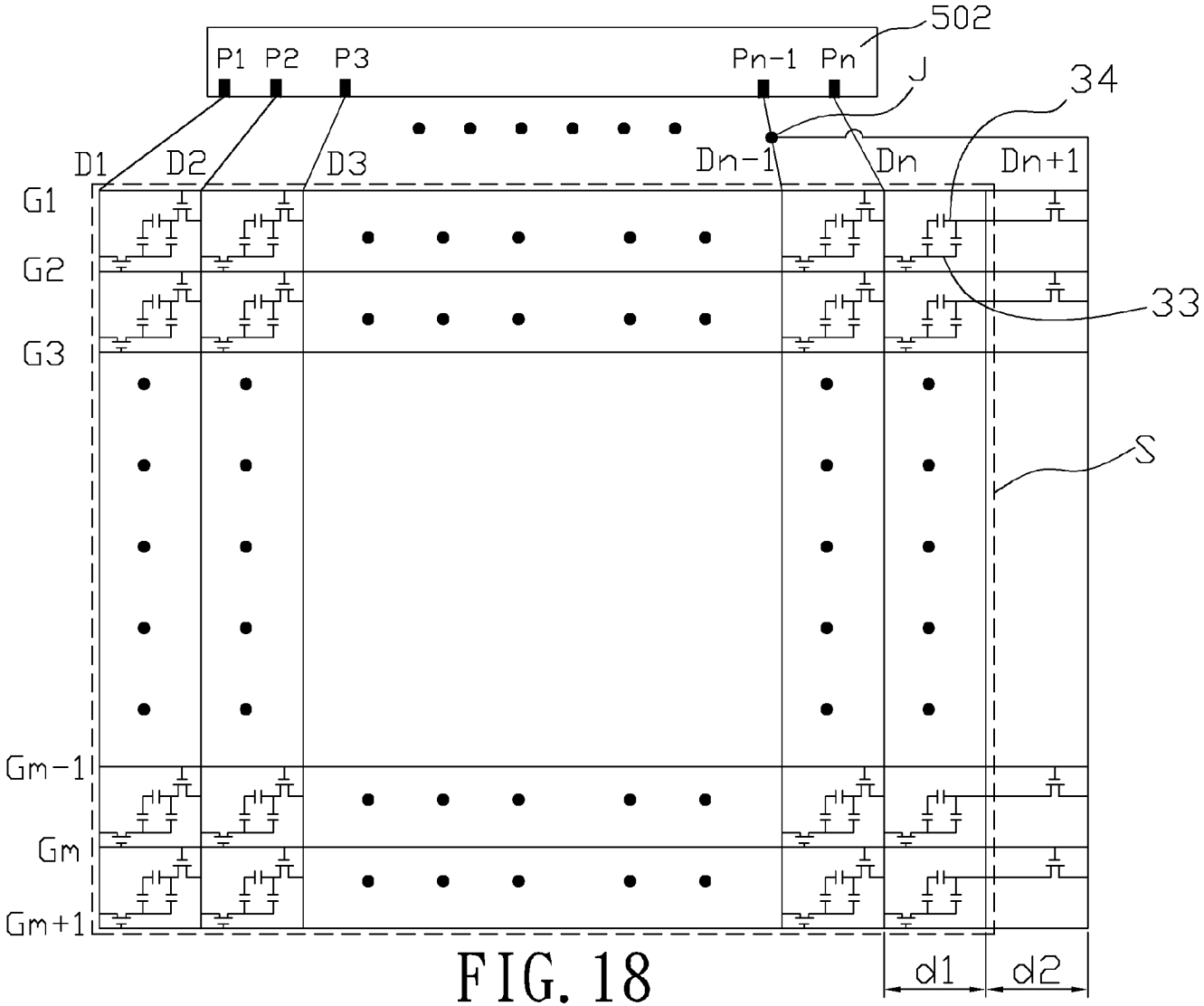
FIG. 18 illustrates a pixel matrix of another embodiment according to the third embodiment of the present invention.

In FIG. 16, preferably, the width of the first sub-pixel column is designed to equal to that of the second sub-pixel column and further equal to those of the other pixel columns, and that can make the size and specification of the pixel configure as well as the photo masks for the pixel manufacture easy to design and perform. Since the interval between the boundary data line and the auxiliary line L maintain a distance equal to the width of the pixel column, the parasitic capacitors between the two conductive lines can also be eliminated. In addition, in another embodiment, the second thin film transistor $T_2$ in the first sub-pixel column in FIG. 16 can also be located in the second sub-pixel column, namely, located outside the display area S, as shown in FIG. 17. Similarly, as the above mentions, in another embodiment, instead of the data line $D_1$, it can also take the data line $D_{n+1}$ as a boundary data line as described in FIG. 9 and FIG. 15 to design a pixel matrix, as eventually shown in FIG. 18.

As the above descriptions, the characters and the advantages of the invention are to provide a display panel having a pixel matrix, wherein the number of the data lines of the pixel matrix is larger than that of the total pixel columns and the display panel can match up a conventional source driver to operate it, that is, the all requirement data signals can be totally provided by the conventional source driver and a new designed source driver would not be needed any more. The invention also provides a pixel configure as well as a driving method to resolve the signal RC delay problem and the asymmetric parasitic capacitor effect. However, the designs of the present invention are not only limited to the display panel having the pixel configure as shown in FIG. 6, it can also be applied in any other display panel which has the following features: (1) a pixel matrix having n pixel columns and m pixel rows, wherein a plurality of pixels are formed in the intersections of the n+1 data line and the m+1 scanning line (2) each of the pixels at least has two thin film transistors and a pixel electrode, and each the pixel is controlled through the signals respectively provided by two adjacent data lines respectively located at the left and right side of the pixel. Thus, as the above two features show, the present invention can also be employed in a display panel having three or more thin film transistors.

The above-described embodiments of the present invention are intended to be illustrative only. Numerous alternative embodiments may be devised by persons skilled in the art without departing from the scope of the following claims.

What is claimed is:

1. A liquid crystal display panel, comprising:

a plurality of scanning lines;

a plurality of data lines for transmitting data signals;

a pixel matrix having a plurality of pixels which are formed in the intersections of said scanning lines and said data lines, and said pixel comprising:

a pixel electrode;

a control electrode;

a first thin film transistor having a gate electrode connected to said scanning line, a first electrode connected to said data line and a second electrode connected to said pixel electrode;

a second thin film transistor having a gate electrode connected to another adjacent said scanning line, a first electrode connected to another adjacent said data line and a second electrode connected to said control electrode; and wherein one of the two most outside said data lines of said pixel matrix is called a boundary data line, and an auxiliary line is disposed between said boundary data line and said pixel electrode adjacent to said boundary data line, one of the terminals of said boundary data line is directly electrically connected to another said data line not being adjacent to said boundary data line without through other electronic element, and said boundary data line, said adjacent pixel electrode and said auxiliary line are all located in a same first or last pixel column, and said auxiliary line is a straight line passing through all the pixels of the same first or last pixel column and has no direct connection with any voltage as well as with a liquid crystal capacitor of each of said pixels.

2. The liquid crystal display panel of claim 1, wherein the polarity of said boundary data line is opposing to that of its adjacent said data line.

3. The liquid crystal display panel of claim 1, wherein said auxiliary line is located between said boundary data line and said control electrode adjacent to it.

4. The liquid crystal display panel of claim 3, wherein said auxiliary line and its adjacent said pixel electrode constitute the two electrodes of a first capacitor.

5. The liquid crystal display panel of claim 4, wherein said auxiliary line and its adjacent said control electrode constitute the two electrodes of a second capacitor.

6. The liquid crystal display panel of claim 5, wherein said auxiliary line and said boundary data line constitute the two electrodes of a third capacitor.

7. The liquid crystal display panel of claim 6, wherein there is a interval between said auxiliary line and said boundary data line to make the value of said third capacitor is smaller than that of said first capacitor or said second capacitor.

8. The liquid crystal display panel of claim 7, wherein said interval is substantially equal to the width of each of said pixels.

9. The liquid crystal display panel of claim 1, wherein the area between said auxiliary line and the other one of said two most outside said data lines is a display area of said liquid crystal display panel.

10. The liquid crystal display panel of claim 9, wherein said thin film transistor connected to said boundary data line is located outside or inside said display area.

11. The liquid crystal display panel of claim 1, wherein said boundary data line is located outside the display area of said liquid crystal display panel, and there is a minimum interval between said auxiliary and said boundary data lines which are parallel with each other, and said minimum interval is substantially equal to a width of each of said pixels.

12. A liquid crystal display panel, comprising:

a pixel matrix having n pixel columns and m pixel rows;

a plurality of pixels which are formed in the intersections of n+1 data lines and m+1 scanning lines of said pixel matrix, wherein said pixel comprises:

at least two thin film transistors and a pixel electrode, and said pixel is controlled through the signals respectively provided by two adjacent said data lines of said pixel; and wherein the first said data line or the n+1th said data line of said pixel matrix is called a boundary data line, and an auxiliary line is disposed between its adjacent said pixel electrode and said boundary data line, one of the terminals of said boundary data line is directly electrically connected to another said data line not being adjacent to said boundary data line without through other electronic element, and said boundary data line, said adjacent pixel electrode and said auxiliary line are all located in a same first or last pixel column, and said auxiliary line is a straight line passing through all the pixels of the same first or last pixel column and has no direct connection with any voltage as well as with a liquid crystal capacitor of each of said pixels.

13. The liquid crystal display panel of claim 12, wherein the polarity of said boundary data line is opposing to that of its adjacent said data line.

14. The liquid crystal display panel of claim 12, wherein the connecting point of said boundary data line and said another said data line is located outside said pixel matrix.

15. The liquid crystal display panel of claim 12, further comprises a driver for providing n data signals corresponding to said data lines except for the first said data line, wherein said first said data line is said boundary data line.

16. The liquid crystal display panel of claim 12, further comprises a driver for providing n data signals corresponding to said data lines except for the n+1th said data line, wherein said n+1th said data line is said boundary data line.

17. The liquid crystal display panel of claim 12, wherein said first data line and said n+1th said data line are respectively the two most outside said data lines of said pixel matrix, and the area between said auxiliary line and the other one of said two most outside said data lines is a display area of said liquid crystal display panel.

18. The liquid crystal display panel of claim 17, wherein said thin film transistor which is connected to said boundary data line is located outside or inside said display area.

19. The liquid crystal display panel of claim 12, wherein there is an interval between said auxiliary line and its adjacent said data line, and said interval is substantially equal to the width of other said pixel column.

20. The liquid crystal display panel of claim 12, wherein said auxiliary line and its adjacent said pixel electrode constitute the two electrodes of a first capacitor.

21. The liquid crystal display panel of claim 20, wherein said auxiliary line and said boundary data line constitute the two electrodes of a second capacitor.

22. The liquid crystal display panel of claim 21, wherein there is a interval between said auxiliary line and said boundary data line to make the value of said second capacitor is smaller than that of said first capacitor.

23. The liquid crystal display panel of claim 12, wherein said pixel further comprises an another electrode connected to one of said two thin film transistors, and said auxiliary line is disposed between said another electrode and said boundary data line.

24. The liquid crystal display panel of claim 23, wherein said auxiliary line and its adjacent said control electrode constitute the two electrodes of a third capacitor.

25. The liquid crystal display panel of claim 12, wherein said boundary data line is located outside the display area of said liquid crystal display panel, and there is a minimum interval between said auxiliary and said boundary data lines which are parallel with each other, and said minimum interval is substantially equal to a width of each of said pixels.

26. A driving method for a liquid crystal display panel, wherein said liquid crystal display panel comprises: a pixel matrix having n pixel columns and m pixel rows; a plurality of pixels which are formed in the intersections of n+1 data lines and m+1 scanning lines of said pixel matrix, wherein said pixel is respectively coupled to its two adjacent data lines and two adjacent scanning lines, one of the two most outside said data lines of said pixel matrix is called a boundary data line, and an auxiliary line is disposed between its adjacent said pixel electrode and said boundary data line, said boundary data line, said adjacent pixel electrode and said auxiliary line are all located in a same first or last pixel column, said auxiliary line is a straight line passing through all the pixels of the same first or last pixel column and has no direct connection with any voltage as well as with a liquid crystal capacitor of each of said pixels, and said method comprises the steps of:

providing n data line signals respectively for said n+1 data lines, wherein said boundary data line and its non-adjacent said data line together share one of said n data line signals, wherein said auxiliary line and its adjacent said pixel electrode constitute a first capacitor; and controlling said pixel through the data signals of said two adjacent data lines and the scanning signals of said two adjacent scanning lines for said pixel.

27. The driving method for a liquid crystal display panel of claim 26, the polarity of said boundary data line is opposing to that of its adjacent said data line.

28. The driving method for a liquid crystal display panel of claim 26, wherein said pixel further comprises at least two thin film transistors respectively coupled to said two adjacent scanning lines and a control electrode coupled to one of said two thin film transistors.

29. The driving method for a liquid crystal display panel of claim 28, wherein said auxiliary line and said control electrode constitute the two electrodes of a second capacitor.

30. The driving method for a liquid crystal display panel of claim 29, wherein said auxiliary line and said boundary data line constitute the two electrodes of a third capacitor.

31. The driving method for a liquid crystal display panel of claim 30, wherein the value of said third capacitor is smaller than that of said first capacitor or said second capacitor.

32. The driving method for a liquid crystal display panel of claim 26, wherein said boundary data line is located outside the display area of said liquid crystal display panel, and there is a minimum interval between said auxiliary and said boundary data lines which are parallel with each other, and said minimum interval is substantially equal to a width of each of said pixels.

* * * * *